US011391278B2

(12) United States Patent
Okaguchi

(10) Patent No.: US 11,391,278 B2
(45) Date of Patent: Jul. 19, 2022

(54) FLUID CONTROL DEVICE

(71) Applicant: Murata Manufacturing Co., Ltd., Kyoto (JP)

(72) Inventor: Kenjiro Okaguchi, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 16/994,970

(22) Filed: Aug. 17, 2020

(65) Prior Publication Data

US 2020/0378380 A1 Dec. 3, 2020

Related U.S. Application Data

(63) Continuation of application No. PCT/JP2019/002922, filed on Jan. 29, 2019.

(30) Foreign Application Priority Data

Apr. 10, 2018 (JP) ..... JP2018-075104

(51) Int. Cl.
*F04B 49/03* (2006.01)
*F04B 17/00* (2006.01)
(Continued)

(52) U.S. Cl.
CPC ..... *F04B 49/03* (2013.01); *F04B 17/003* (2013.01); *F04B 23/02* (2013.01); *F04B 23/04* (2013.01);
(Continued)

(58) Field of Classification Search
CPC .... F04B 43/046; F04B 49/06; F04B 43/0045; F04B 17/003; F04B 2203/0402;
(Continued)

(56) References Cited

U.S. PATENT DOCUMENTS 5,611,676 A * 3/1997 Ooumi ..... F04B 43/046 417/322
9,234,516 B2 * 1/2016 Takahashi ..... A61B 17/3203
(Continued)

FOREIGN PATENT DOCUMENTS

JP S53-22602 A 3/1978
JP S53-116501 A 10/1978
(Continued)

OTHER PUBLICATIONS

International Search Report issued in Application No. PCT/JP2019/002922, dated Apr. 23, 2019.
(Continued)

*Primary Examiner* — Peter J Bertheaud
(74) *Attorney, Agent, or Firm* — Pearne & Gordon LLP

(57) ABSTRACT

A fluid control device includes a piezoelectric pump, a piezoelectric pump, a valve, and a container. The piezoelectric pump and the piezoelectric pump repeat the operation and the stop in accordance with a drive control cycle. The valve starts a control to close at the start timing of one cycle of the drive control cycle and starts a control to open at the stop of the piezoelectric pump and the piezoelectric pump. The time from the start timing of one cycle of the drive control cycle to the time at which the piezoelectric pump on the upstream side pump reaches a normal operation drive voltage is longer than the time from the start timing to the time at which the piezoelectric pump on the downstream side reaches a normal operation drive voltage.

20 Claims, 14 Drawing Sheets

(51) Int. Cl.

| | |
|---|---|
| ***F04B 23/02*** | (2006.01) |
| ***F04B 23/04*** | (2006.01) |
| ***F04B 49/06*** | (2006.01) |
| ***F04B 43/00*** | (2006.01) |
| ***F04B 43/04*** | (2006.01) |
| ***F04B 43/02*** | (2006.01) |
| ***F04B 25/00*** | (2006.01) |
| ***F04B 41/06*** | (2006.01) |
| ***F04B 23/06*** | (2006.01) |

(52) U.S. Cl.
CPC ..... *F04B 23/06* (2013.01); *F04B 25/00* (2013.01); *F04B 41/06* (2013.01); *F04B 43/0045* (2013.01); *F04B 43/02* (2013.01); *F04B 43/043* (2013.01); *F04B 43/046* (2013.01); *F04B 49/06* (2013.01); *F04B 2203/0402* (2013.01)

(58) Field of Classification Search
CPC ..... F04B 41/06; F04B 43/02; F04B 43/043; F04B 25/00; F04B 23/04; F04B 23/06; F04B 49/03; F04B 23/02
See application file for complete search history.

(56) References Cited

U.S. PATENT DOCUMENTS

| | | | | |
|---|---|---|---|---|
| 9,482,221 | B2 * | 11/2016 | Kamitani ..... | F04B 49/007 |
| 2012/0051946 | A1 * | 3/2012 | Lee ..... | F04B 43/046 417/413.2 |
| 2017/0365768 | A1 | 12/2017 | Okaguchi | |

FOREIGN PATENT DOCUMENTS

| | | | |
|---|---|---|---|
| JP | H07-238888 | A | 9/1995 |
| JP | 2004-169706 | A | 6/2004 |
| JP | 2009-264351 | A | 11/2009 |
| JP | 6160800 | B1 | 7/2017 |
| WO | 2012/140931 | A1 | 10/2012 |

OTHER PUBLICATIONS

Written Opinion issued in Application No. PCT/JP2019/002922, dated Apr. 23, 2019.

* cited by examiner

| ST | 1 | 2 | 3 | 4 | 5 | 6 | 7 | 8 | 9 | 10 |
|---|---|---|---|---|---|---|---|---|---|---|
| PUMP IN OPERATION | 22,24 | 21,22, 23,24 | 21,22 | 21,22, 23,24 | – | 22,24 | 21,22, 23,24 | 23,24 | 21,22, 23,24 | – |
| VALVE | CL | CL | CL | CL | OP | CL | CL | CL | CL | OP |

| ST | 1 | 2 | 3 | 4 | 5 | 6 | 7 | 8 | 9 | 10 |
|---|---|---|---|---|---|---|---|---|---|---|
| PUMP IN OPERATION | 22,24 | 21,22, 23,24 | 21,22 | 21,22, 23,24 | – | 22,24 | 21,22, 23,24 | 21,22 | 21,22, 23,24 | – |

| ST | 1 | 2 | 3 | 4 | 5 | 6 | 7 | 8 | 9 | 10 |
|---|---|---|---|---|---|---|---|---|---|---|
| PUMP IN OPERATION | 22,24 | 21,22, 23,24 | 23,24 | 21,22, 23,24 | – | 22,24 | 21,22, 23,24 | 23,24 | 21,22, 23,24 | – |

| ST | 1 | 2 | 3 | 4 | 5 | 6 | 7 | 8 | 9 | 10 |
|---|---|---|---|---|---|---|---|---|---|---|
| PUMP IN OPERATION | 22,24 | 21,22, 23,24 | 21,22 | 21,22, 23,24 | – | 21,23 | 21,22, 23,24 | 23,24 | 21,22, 23,24 | – |

| ST | 1 | 2 | 3 | 4 | 5 | 6 | 7 | 8 | 9 | 10 |
|---|---|---|---|---|---|---|---|---|---|---|
| PUMP IN OPERATION | 22,24 | 21,22, 23,24 | 21,22 | 21,22 | – | 22,24 | 21,22, 23,24 | 23,24 | 23,24 | – |

FLUID CONTROL DEVICE

This is a continuation of International Application No. PCT/JP2019/002922 filed on Jan. 29, 2019 which claims priority from Japanese Patent Application No. 2018-075104 filed on Apr. 10, 2018. The contents of these applications are incorporated herein by reference in their entireties.

BACKGROUND

Technical Field

The present disclosure relates to a fluid control device that uses a piezoelectric pump to move fluids to a predetermined direction.

Patent Document 1 describes a fluid control device including a piezoelectric pump and a driver circuit. The driver circuit is connected to the piezoelectric pump and supplies a drive voltage to the piezoelectric pump. The piezoelectric pump sucks fluids from a suction inlet and discharges from a discharge outlet in response to the drive voltage. This moves fluids in a predetermined direction.

Patent Document 1: Japanese Patent No. 6160800 specification

BRIEF SUMMARY

As a way to use a fluid control device, it is conceivable to use a fluid control device in which capability, for example, pressure is improved. Because of this, in the related art, it is conceivable to use a fluid control device in which piezoelectric pumps are connected in series. The term "connected in series" means that for example, in the case where two piezoelectric pumps (first piezoelectric pump and second piezoelectric pump) are being used, a discharge outlet of the first piezoelectric pump is communicating with a suction inlet of the second piezoelectric pump.

In this configuration, the pressure is improved by simultaneously driving the first piezoelectric pump and the second piezoelectric pump.

However, such configuration and control develop a problem in that the amount of power consumption increases more than necessary.

The present disclosure provides a fluid control device that suppresses unnecessary power consumption.

A fluid control device of the present disclosure includes a first pump, a second pump, a container, a first communicating path, a second communicating path, a valve, a first control unit, and a second control unit. The first pump includes a first hole and a second hole and moves a fluid between the first hole and the second hole. The second pump includes a third hole and a fourth hole and moves a fluid between the third hole and the fourth hole. The first communicating path communicates with the second hole and the third hole. The second communicating path communicates with the fourth hole and the container. The valve is installed in the second communicating path and switches between opening the second communicating path to outside and closing the second communicating path from the outside.

The first control unit controls driving of the first pump and the second pump. Specifically, the first control unit generates a drive signal for the first pump and a drive signal for the second pump, and the first pump and the second pump repeat a start of operation and a stop of operation in accordance with a drive control cycle. The second control unit controls opening and closing of the valve. Specifically, the second control unit generates a control signal to start a control to close the valve at start timing of one cycle of the drive control cycle and to start a control to open the valve at time of stopping the first pump and the second pump. Time from the start timing of one cycle of the drive control cycle to time at which, of the first pump and the second pump, an upstream side pump with respect to a flow of the fluid reaches a normal operation drive voltage is longer than time from the start timing to time at which, of the first pump and the second pump, a downstream side pump with respect to the flow of the fluid reaches a normal operation drive voltage. The normal operation is a state where the pump is operating at a constant voltage that is the maximum value of the drive voltage within one cycle of the drive control cycle. Note that meanings of the terms "maximum value" and "constant" are within the range of control errors.

This configuration shortens the application time of the drive voltage to the upstream side pump without necessarily significantly decreasing the pressure of the fluid control device.

Further, in the fluid control device of the present disclosure, the normal operation drive voltage of the upstream side pump can be lower than the normal operation drive voltage of the downstream side pump.

This configuration suppresses the power consumption of the upstream side pump at the time of normal operation without necessarily significantly decreasing the pressure.

Further, in the fluid control device of the present disclosure, a drive voltage to be applied to the upstream side pump can be equal to or less than a drive voltage to be applied to the downstream side pump.

This configuration constantly suppresses the power consumption of the upstream side pump without necessarily significantly decreasing the pressure.

Further, in the fluid control device of the present disclosure, the drive voltage may be applied to the upstream side pump after stopping the upstream side pump for a predetermined time period from the start timing.

This configuration facilitates the control of the drive voltage for the upstream side pump.

Further, the fluid control device of the present disclosure can have the following configuration. The drive voltage is applied simultaneously to the upstream side pump and the downstream side pump at the start timing. A change rate of the drive voltage for the upstream side pump during a period of transition is lower than a change rate of the drive voltage for the downstream side pump during a period of transition.

This configuration improves drive efficiency while suppressing the power consumption.

Further, in the fluid control device of the present disclosure, the first control unit and the second control unit may be formed into a single control device.

This configuration facilitates synchronization of controls of the first control unit and the second control unit, that is, synchronization of operations of the first pump, the second pump, and the valve.

Further, in the fluid control device of the present disclosure, the stop timing of the downstream side pump may be later than the stop timing of the upstream side pump.

This configuration allows the upstream side pump to be cooled, thereby ensuring more stable operation.

The present disclosure enables to suppress unnecessary power consumption.

DETAILED DESCRIPTION

Figure 1:
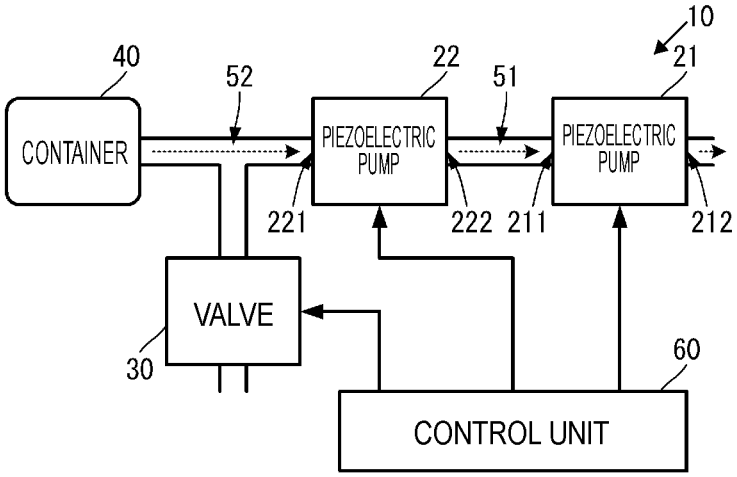
FIG. 1 is a block diagram illustrating the configuration of a fluid control device 10 according to a first embodiment of the present disclosure.

A fluid control device according to a first embodiment of the present disclosure is now described with reference to the drawings. FIG. 1 is a block diagram illustrating the configuration of a fluid control device 10 according to a first embodiment of the present disclosure.

As illustrated in FIG. 1, a fluid control device 10 includes a piezoelectric pump 21, a piezoelectric pump 22, a valve 30, a container 40, a communicating path 51, a communicating path 52, and a control unit 60. The fluid control device 10 is a device that sucks a fluid from the container 40 side, and is used in a milking machine, for example.

The piezoelectric pump 21 includes a hole 211 and a hole 212 provided on a housing. The piezoelectric pump 21 includes a piezoelectric element. The housing includes a pump chamber. The pump chamber communicates with the hole 211 and the hole 212. Note that the housing, the pump chamber, and the piezoelectric element are not illustrated in the drawings.

The piezoelectric pump 21 moves a fluid between the hole 211 and the hole 212 by varying the volume or pressure of the pump chamber using displacement of the piezoelectric element caused by a drive voltage. In the present embodiment, the hole 211 is the suction inlet, and the hole 212 is the discharge outlet. The piezoelectric pump 21 corresponds to "first pump" of the present disclosure. The hole 212 corresponds to "first hole" of the present disclosure, and the hole 211 corresponds to "second hole" of the present disclosure.

The piezoelectric pump 22 includes a hole 221 and a hole 222 provided on a housing. The piezoelectric pump 22 includes a piezoelectric element. The housing includes a pump chamber. The pump chamber communicates with the hole 221 and the hole 222. Note that the housing, the pump chamber, and the piezoelectric element are not illustrated in the drawings.

The piezoelectric pump 22 moves a fluid between the hole 221 and the hole 222 by varying the volume or pressure of the pump chamber using displacement of the piezoelectric element caused by a drive voltage. In the present embodiment, the hole 221 is the suction inlet, and the hole 222 is the discharge outlet. The piezoelectric pump 22 corresponds to "second pump" of the present disclosure. The hole 222 corresponds to "third hole" of the present disclosure, and the hole 221 corresponds to "fourth hole" of the present disclosure.

The communicating path 51 is tubular. The hole 211 of the piezoelectric pump 21 and the hole 222 of the piezoelectric pump 22 are communicating with each other via the communicating path 51. The communicating path 51 corresponds to "first communicating path" of the present disclosure.

The communicating path 52 is tubular. The hole 221 of the piezoelectric pump 22 and the container 40 are communicating with each other via the communicating path 52. The communicating path 52 corresponds to "second communicating path" of the present disclosure.

The valve 30 is installed in the communicating path 52. The valve 30 opens the inside of the communicating path 52 to the outside (valve open state) or closes the inside of the communicating path 52 from the outside (valve close state) in response to the valve control signal.

The control unit 60 generates drive voltages for the piezoelectric pump 21 and the piezoelectric pump 22 and respectively supplies these drive voltages to the piezoelectric pump 21 and the piezoelectric pump 22. Further, the control unit 60 generates the valve control signal and supplies to the valve 30. The control unit 60 performs a drive control of the piezoelectric pump 21 and the piezoelectric pump 22 and an opening/closing control of the valve 30 in synchronization with each other. The control unit 60 repeats the drive control of the piezoelectric pump 21 and the piezoelectric pump 22 and the opening/closing control of the valve 30 based on a drive control cycle. The drive control cycle is set in advance.

In outline, the fluid control device 10 starts the operation of the piezoelectric pump 21 and the piezoelectric pump 22 at the time of performing the closing control of the valve 30, moves a fluid from the container 40 to the communicating path 52 to the piezoelectric pump 22 to the communicating path 51 to the piezoelectric pump 21 in this order, and discharges the fluid from the hole 212 of the piezoelectric pump 21. That is to say, the piezoelectric pump 22 corresponds to "upstream side pump" of the present disclosure, and the piezoelectric pump 21 corresponds to "downstream side pump" of the present disclosure. Further, the fluid control device 10 stops the piezoelectric pump 21 and the piezoelectric pump 22 and performs the opening control of the valve 30. Further, the fluid control device 10 repeats these operations in line with the drive control cycle.

Figure 2:
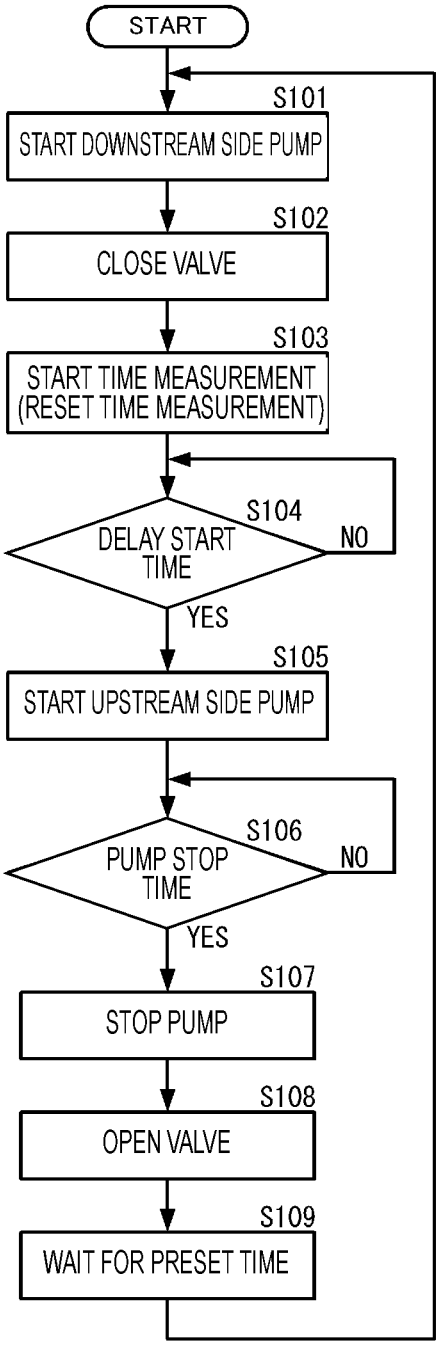
FIG. 2 is a flowchart of a control process performed at the fluid control device 10 according to the first embodiment of the present disclosure.

FIG. 2 is a flowchart of a control process performed at the fluid control device according to the first embodiment of the present disclosure.

As illustrated in FIG. 2, the fluid control device 10 starts the downstream side pump (piezoelectric pump 21 in the first embodiment) at the start timing of one cycle of the drive control cycle (S101). The fluid control device 10 performs the closing control of the valve 30 (S102). The fluid control device 10 starts a time measurement or resets the time measurement when the control is in progress (S103). The step S101, the step S102, and the step S103 are performed at substantially the same time. Note that the step S101, the step S102, and the step S103 may be performed with some time differences or the order of these steps may be replaced, within the range where functionalities of the fluid control device 10 can be actualized. Particularly, in a mode where the order of the steps is replaced, the power consumption can be suppressed.

The fluid control device 10 refers to the measured time and continues the time measurement until a delay start time (S104: NO). Upon reaching the delay start time (S104: YES), the fluid control device 10 starts the upstream side pump (piezoelectric pump 22 in the first embodiment) (S105).

The fluid control device 10 causes the upstream side pump and the downstream side pump to continue their operations until a pump stop time (S106: NO).

Upon reaching the pump stop time (S106: YES), the fluid control device 10 stops the upstream side pump and the downstream side pump (S107). The fluid control device 10 performs the opening control of the valve 30 (S108). The step S107 and the step S108 are performed at substantially the same time. The step S108 may be performed with some time differences within the range where functionalities of the fluid control device 10 can be actualized.

Note that in the step S107, the stop timing of the downstream side pump (piezoelectric pump 21) may be delayed from the stop timing of the upstream side pump (piezoelectric pump 22). This allows the upstream side pump to be cooled, thereby ensuring more stable operation.

Further, in the configuration described above, the configuration in which the upstream side pump is started after starting the downstream side pump is illustrated. Alternatively, the downstream side pump may be started after starting the upstream side pump. At this time, the stop timing of the upstream side pump may be delayed from the stop timing of the downstream side pump.

The fluid control device 10 stops the upstream side pump and the downstream side pump, waits for a predetermined time period in the state where the opening control of the valve 30 is performed (S109), ends the one cycle of the drive control cycle, and returns to the step S101.

With such control, the driving time of the upstream side pump is shorter than that of the downstream side pump. That is to say, the application time of drive voltage to the upstream side pump becomes shorter than the application time of drive voltage to the downstream side pump. Because of this, compared with a prior art configuration in which the upstream side pump and the downstream side pump are driven at the same time, the fluid control device 10 can suppress the amount of power consumption.

Figure 3A:
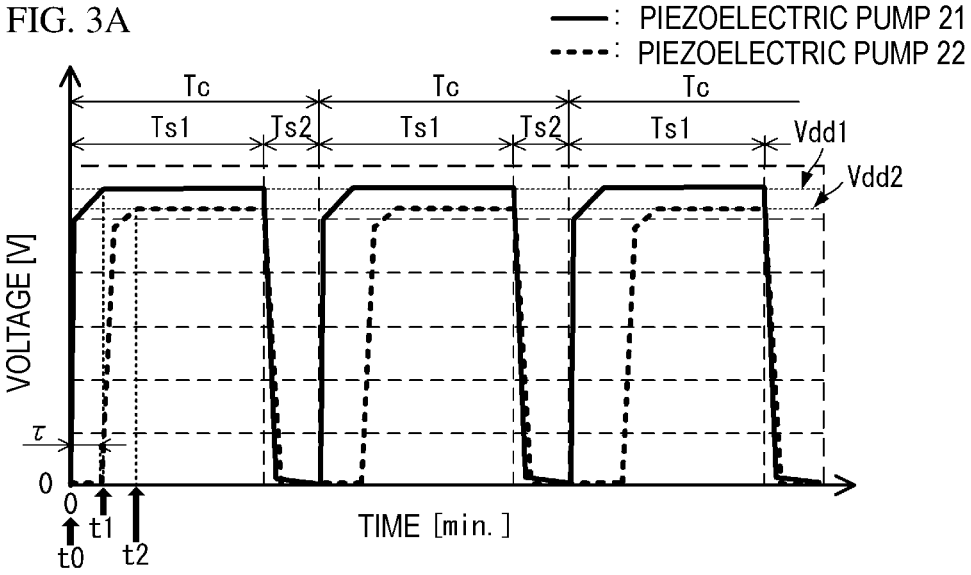
FIG. 3A and FIG. 3B are diagrams illustrating waveforms of drive voltages for a piezoelectric pump 21 and a piezoelectric pump 22.
Figure 3B:
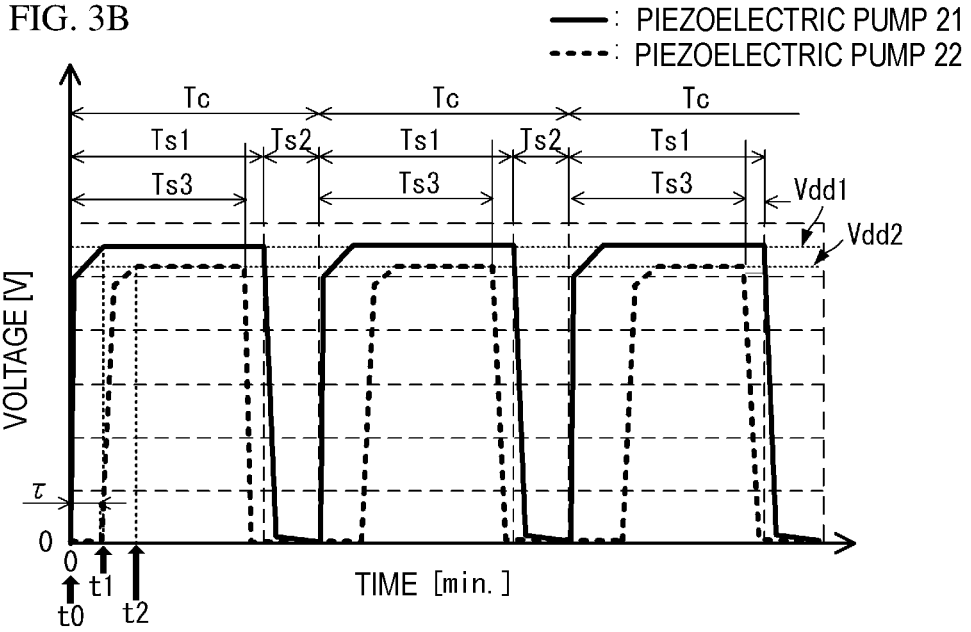

FIG. 3A and FIG. 3B are diagrams illustrating waveforms of drive voltages for the piezoelectric pump 21 and the piezoelectric pump 22. In FIG. 3A and FIG. 3B, t0 is the start timing of one cycle. t1 is the first timing at which the drive voltage of the piezoelectric pump 21 (downstream side pump) reaches a normal operation drive voltage. t2 is the first timing at which the drive voltage of the piezoelectric pump 22 (upstream side pump) reaches the normal operation drive voltage. Tc is the drive control cycle. Ts1 is a drive time. Ts2 is a non-drive time and corresponds to a waiting time of the step S109 described above. The drive control cycle Tc is an added time of the drive time Ts1 and the non-drive time Ts2.

As illustrated in FIG. 3A, the fluid control device 10 starts applying the drive voltage to the piezoelectric pump 21 at the start timing t0. At this time, the fluid control device 10 gradually increases the drive voltage at a predetermined voltage change rate. At the timing (time) t1, the fluid control device 10 sets the drive voltage being applied to the piezoelectric pump 21 at a normal operation drive voltage Vdd1 and keeps the drive voltage constant thereafter.

The fluid control device 10 starts applying the drive voltage to the piezoelectric pump 22 after a lapse of a delay time $\tau$ from the start timing t0. At this time, the fluid control device 10 gradually increases the drive voltage at a predetermined voltage change rate. The delay time $\tau$ can be shorter than, for example, the timing at which transition from a flow volume mode to a pressure mode is made. The flow volume mode is a mode where the pressure is relatively low and difficult to increase, and the flow volume is large. The pressure mode is a mode where the pressure is relatively high, and the flow volume is difficult to increase. Further, the delay time $\tau$ can be shorter than, for example, the time to reach about ⅓ of a pressure whose absolute value is the largest, that is, the pressure immediately before performing the opening control of the valve 30.

At the timing (time) t2, the fluid control device 10 sets the drive voltage being applied to the piezoelectric pump 22 at a normal operation drive voltage Vdd2 and keeps this drive voltage constant thereafter. The drive voltage Vdd2 for the piezoelectric pump 22 is lower than the drive voltage Vdd1 for the piezoelectric pump 21.

Note that the ratio of the drive voltage Vdd2 to the drive voltage Vdd1 can be within 30% or less given individual variation of piezoelectric pumps.

The fluid control device 10 stops driving the piezoelectric pump 21 and the piezoelectric pump 22 after a lapse of the drive time Ts1 from the start timing t0.

With such control, as described above, the application time of drive voltage to the piezoelectric pump 22 becomes shorter than the application time of drive voltage to the piezoelectric pump 21. Because of this, the power consumption of the piezoelectric pump 22 becomes lower than the power consumption of the piezoelectric pump 21. That is to say, the power consumption of the upstream side pump becomes lower than the power consumption of the downstream side pump.

Further, the application time of the normal operation drive voltage Vdd2 to the piezoelectric pump 22, which is the upstream side pump, becomes shorter than the application time of the normal operation drive voltage Vdd1 to the piezoelectric pump 21, which is the downstream side pump. Because of this, the power consumption of the piezoelectric pump 22 becomes additionally lower than the power consumption of the piezoelectric pump 21. That is to say, the power consumption of the upstream side pump becomes additionally lower than the power consumption of the downstream side pump.

Furthermore, as illustrated in FIG. 3A, the normal operation drive voltage Vdd2 for the piezoelectric pump 22 is lower than the normal operation drive voltage Vdd1 for the piezoelectric pump 21. Because of this, the power consumption of the piezoelectric pump 22 becomes additionally lower than the power consumption of the piezoelectric pump 21. That is to say, the power consumption of the upstream side pump becomes additionally lower than the power consumption of the downstream side pump.

As with FIG. 3A, FIG. 3B is a diagram illustrating the waveforms of drive voltages for the piezoelectric pump 21 and the piezoelectric pump 22.

FIG. 3B is different from FIG. 3A in the stop timing of the piezoelectric pump 22. Specifically, the fluid control device 10 stops driving the piezoelectric pump 22 after a lapse of a drive time Ts3 from the start timing t0 and stops driving the piezoelectric pump 21 after a lapse of the drive time Ts1 from the start timing t0. That is to say, the stop timing of the piezoelectric pump 21 is later than the stop timing of the piezoelectric pump 22.

Even with such control, the application time of drive voltage to the piezoelectric pump 22 becomes shorter than the application time of drive voltage to the piezoelectric pump 21. Because of this, the power consumption of the piezoelectric pump 22 becomes lower than the power consumption of the piezoelectric pump 21. That is to say, the power consumption of the upstream side pump becomes lower than the power consumption of the downstream side pump.

Further, the application time of the normal operation drive voltage Vdd2 to the piezoelectric pump 22, which is the upstream side pump, becomes shorter than the application time of the normal operation drive voltage Vdd1 to the piezoelectric pump 21, which is the downstream side pump. Because of this, the power consumption of the piezoelectric pump 22 becomes additionally lower than the power consumption of the piezoelectric pump 21. That is to say, the power consumption of the upstream side pump becomes additionally lower than the power consumption of the downstream side pump.

Further, by performing the control described above, the piezoelectric pump 22 is cooled. That is to say, the piezoelectric pump 22 operates more stably. Further, the configuration may be such that the stop timing of the piezoelectric pump 21 is later than the stop timing of the piezoelectric pump 22.

Figure 4:
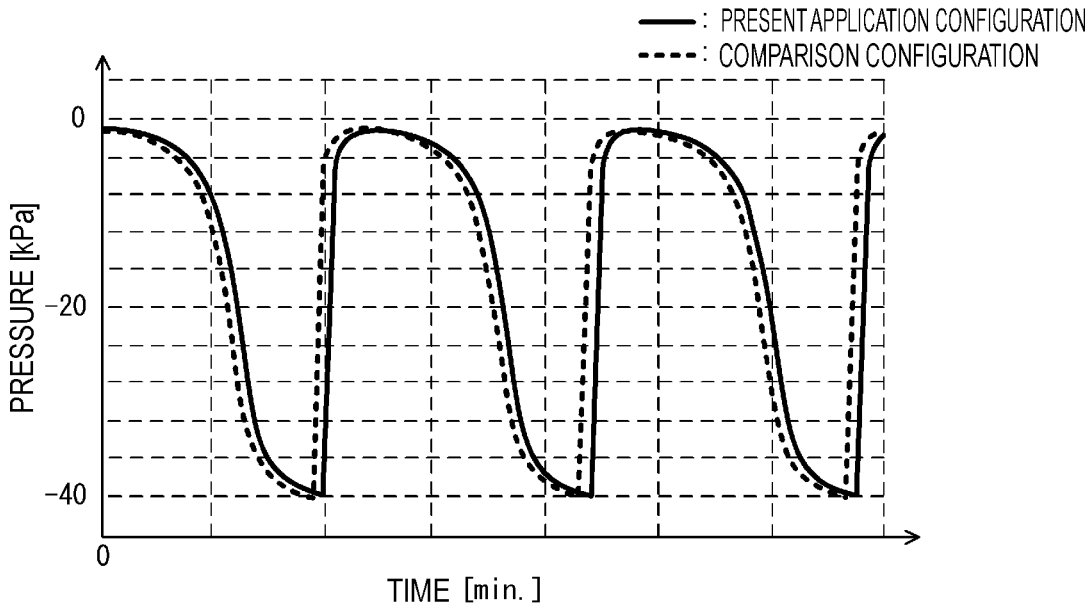
FIG. 4 is a diagram illustrating change patterns of pressure in the fluid control device 10 of the present application and a comparison configuration.

FIG. 4 is a diagram illustrating change patterns of pressure in the fluid control device 10 of the present application and a comparison configuration. In FIG. 4, the horizontal axis is the time, and the vertical axis is the pressure (discharge pressure). In the comparison configuration, the upstream side pump and the downstream side pump operate at the same time, and the normal operation drive voltage of the upstream side pump and the normal operation drive voltage of the downstream side pump are the same.

As illustrated in FIG. 4, with the configuration and the control of the fluid control device 10, the pressure changes in line with the drive control cycle. That is to say, the pressure gradually decreases from the start timing of one cycle of the drive control cycle, reaches the lowest at the end timing of the one cycle of the drive control cycle, and returns to the original pressure.

Although there is some time difference, a pressure similar to that of comparison configuration can be provided even using the configuration of the present application. That is to say, the fluid control device 10 enables to suppress the power consumption without necessarily significantly decreasing pressure capability. In other words, the fluid control device 10 can efficiently provide a desired discharge pressure while suppressing unnecessary power consumption.

Figure 5:
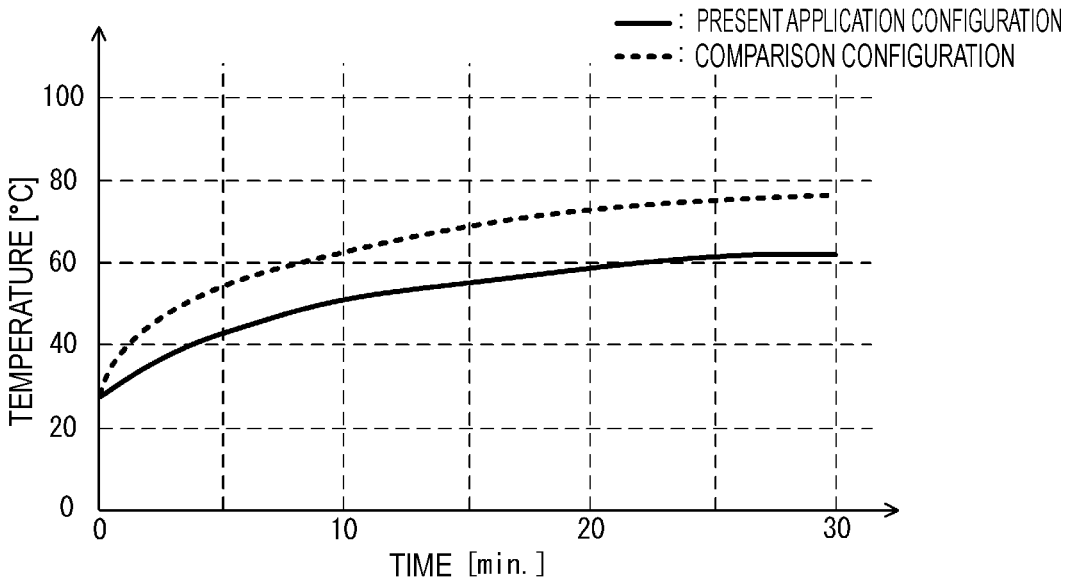
FIG. 5 is a diagram illustrating change patterns of temperature in the fluid control device 10 of the present application and a comparison configuration.

Further, the fluid control device 10 enables to produce the following advantageous effects. FIG. 5 is a diagram illustrating change patterns of temperature in the fluid control device 10 of the present application and a comparison configuration. In FIG. 5, the horizontal axis is the time, and the vertical axis is the surface temperature of the downstream side pump. In the comparison configuration, the upstream side pump and the downstream side pump operate at the same time, and the normal operation drive voltage of the upstream side pump and the normal operation drive voltage of the downstream side pump are the same.

As illustrated in FIG. 5, with the configuration and the control of the fluid control device 10, the temperature increase of the downstream side pump is suppressed. Further, although it is not illustrated in the drawing, the temperature increase of the upstream side pump is also suppressed. This is due to the following reasons. Because of a decrease in the drive voltage of the upstream side pump, a temperature increase at the upstream side pump is suppressed. This suppresses the temperature of a fluid flowing into the downstream side pump. Because the temperature of a fluid flowing into the downstream side pump is suppressed, the temperature increase of the downstream side pump is suppressed.

Figure 6:
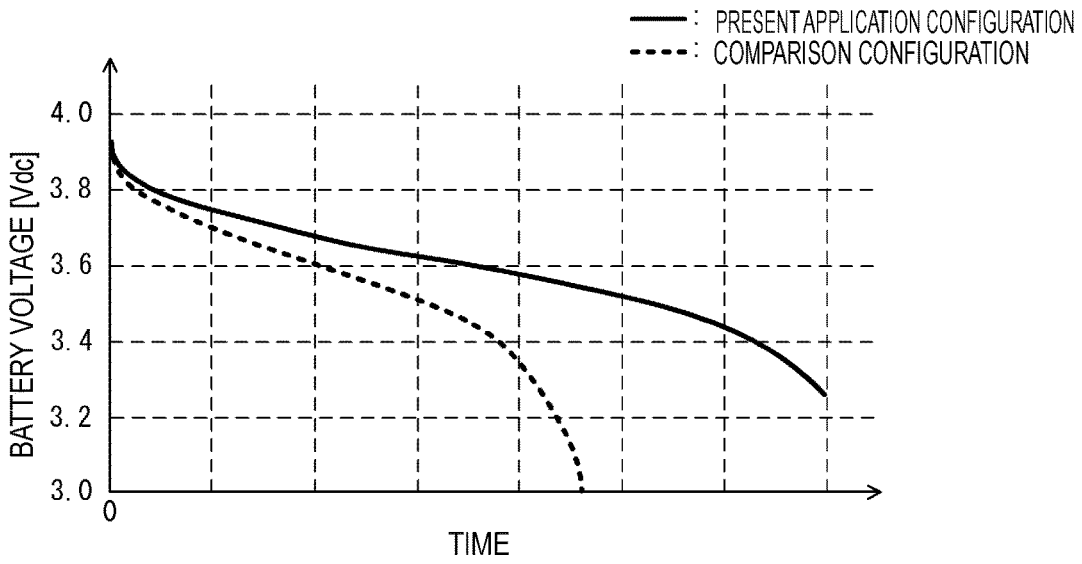
FIG. 6 is a diagram illustrating change patterns of battery voltage (power supply voltage) in the fluid control device 10 of the present application and a comparison configuration.

Further, as illustrated in FIG. 6, the fluid control device 10 enables to suppress the power consumption. FIG. 6 is a diagram illustrating change patterns of battery voltage (power supply voltage) in the fluid control device of the present application and a comparison configuration. In FIG. 6, the horizontal axis is the time, and the vertical axis is the battery voltage. In the comparison configuration, the upstream side pump and the downstream side pump operate at the same time, and the normal operation drive voltage of the upstream side pump and the normal operation drive voltage of the downstream side pump are the same.

As illustrated in FIG. 6, with the configuration and the control of the fluid control device 10, a decrease of the battery voltage can be delayed. That is to say, with the configuration and the control of the fluid control device 10, the battery life can be prolonged while suppressing the power consumption. For example, in the case of FIG. 6, the battery life can be extended to about 1.5 times.

Figure 7:
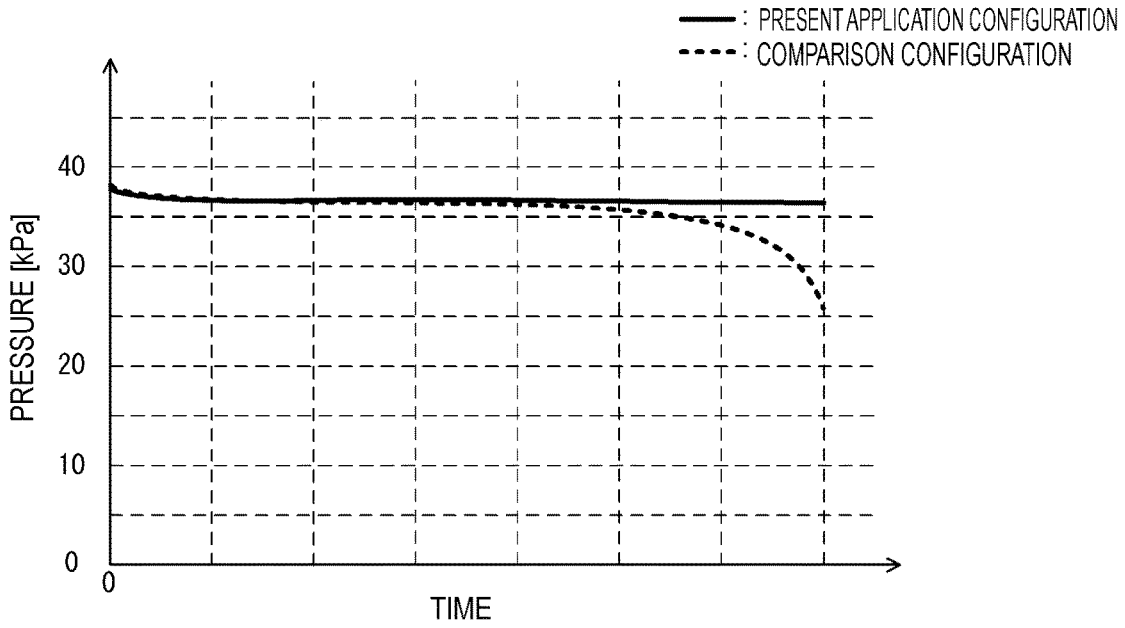
FIG. 7 is a diagram illustrating change patterns of pressure decrease in the fluid control device 10 of the present application and a comparison configuration.

Further, as illustrated in FIG. 7, the fluid control device 10 enables to delay degradation of reliability. FIG. 7 is a diagram illustrating change patterns of pressure decrease in the fluid control device 10 of the present application and a comparison configuration. In FIG. 7, the horizontal axis is the time, and the vertical axis is the pressure. In the comparison configuration, the upstream side pump and the downstream side pump operate at the same time, and the normal operation drive voltage of the upstream side pump and the normal operation drive voltage of the downstream side pump are the same.

As illustrated in FIG. 7, with the configuration and the control of the fluid control device 10, a decrease of the pressure can be substantially delayed. That is to say, with the configuration and the control of the fluid control device 10, a decrease of reliability can be delayed, and a product life can be prolonged.

Note that in the control described above, the mode is described in which the drive start timing of the piezoelectric pump 22 is delayed for the delay time τ from the drive start timing of the piezoelectric pump 21. However, even in the case where the drive start timing of the piezoelectric pump 22 is set equal to the drive start timing of the piezoelectric pump 21, similar functions and effects can be achieved by performing the following control.

Figure 8:
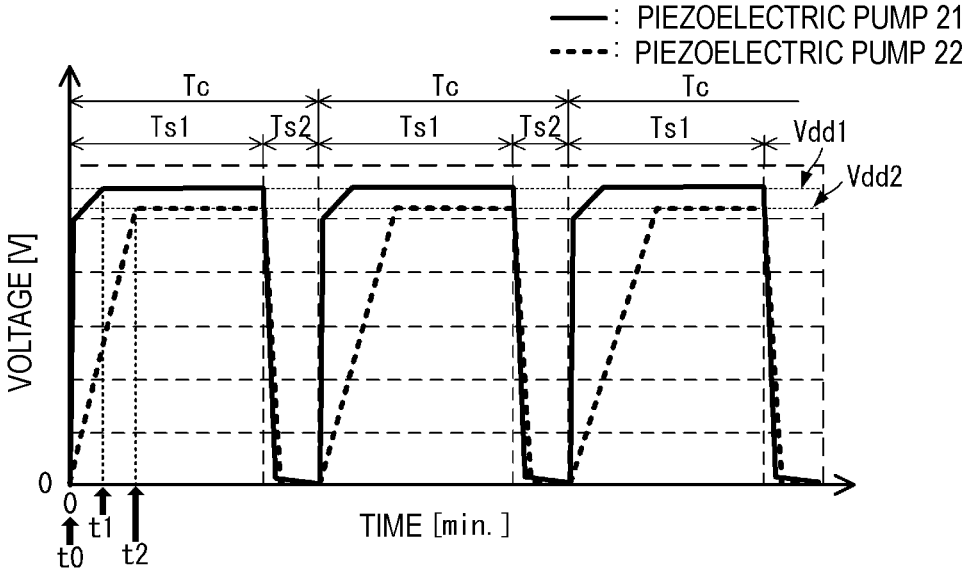
FIG. 8 is a diagram illustrating waveforms of drive voltages for the piezoelectric pump 21 and the piezoelectric pump 22 in a different mode.

FIG. 8 is a diagram illustrating waveforms of drive voltages for the piezoelectric pump 21 and the piezoelectric pump 22 in a different mode. As illustrated in FIG. 8, the fluid control device 10 sets the application start timing of drive voltage to the piezoelectric pump 21 and the application start timing of drive voltage to the piezoelectric pump 22 equal to each other. The fluid control device 10 sets the change rate of the drive voltage for the piezoelectric pump 22 during a period of transition lower than the change rate of the drive voltage for the piezoelectric pump 21. That is to say, the application start timing of the normal operation drive voltage Vdd2 for the piezoelectric pump 22 is delayed from the application start timing of the normal operation drive voltage Vdd1 for the piezoelectric pump 21.

Because of this, the fluid control device 10 can suppress the power consumption. Further, by using this control, the application of the drive voltage for the piezoelectric pump 22 can be performed from the start timing of one cycle of the drive control cycle, and the suction of fluid from the container 40 can be performed more efficiently.

Figure 9:
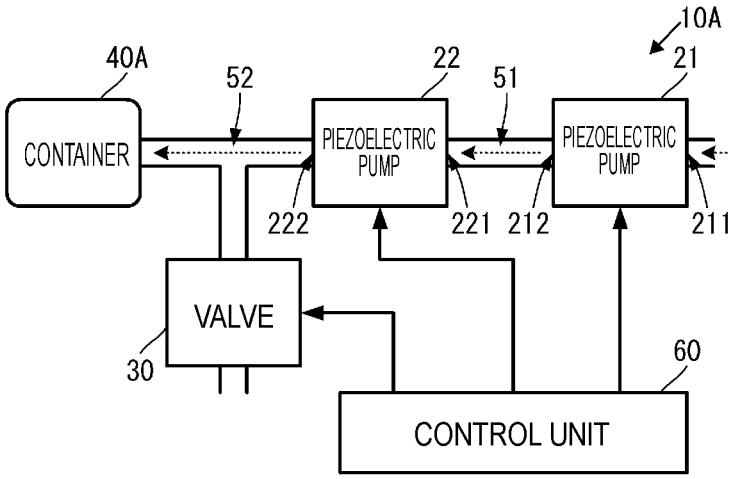
FIG. 9 is a block diagram illustrating the configuration of a fluid control device 10A according to a second embodiment of the present disclosure.

Next, a fluid control device according to a second embodiment is described with reference to the drawings. FIG. 9 is a block diagram illustrating the configuration of a fluid control device 10A according to the second embodiment of the present disclosure.

As illustrated in FIG. 9, compared with the fluid control device 10 according to the first embodiment, the fluid control device 10A according to the second embodiment is a device in which the flow of a fluid is reversed. With regard to parts of the fluid control device 10A similar to those of the fluid control device 10, the description is omitted. The fluid control device 10A is used in, for example, a blood pressure meter and the like.

In the fluid control device 10A, the hole 212 of the piezoelectric pump 21 and the hole 221 of the piezoelectric pump 22 are communicating with each other via the communicating path 51. The hole 222 of the piezoelectric pump 22 and the container 40A are communicating with each other via the communicating path 52. Accordingly, in the fluid control device 10A, the piezoelectric pump 21 is the upstream side pump, and the piezoelectric pump 22 is the downstream side pump.

Figure 10:
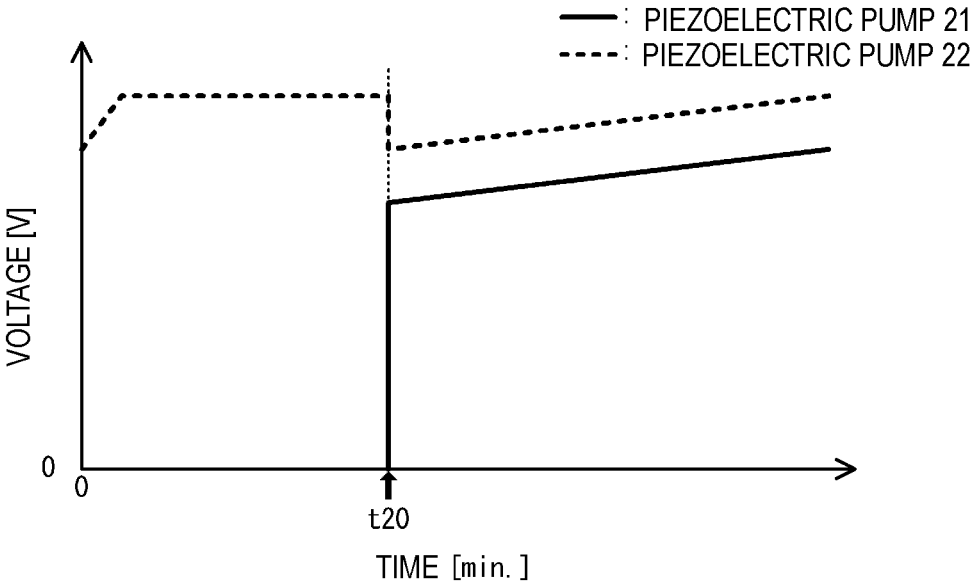
FIG. 10 is a diagram illustrating waveforms of drive voltages for the piezoelectric pump 21 and the piezoelectric pump 22.

FIG. 10 is a diagram illustrating waveforms of drive voltages for the piezoelectric pump 21 and the piezoelectric pump 22. As illustrated in FIG. 10, the fluid control device 10A applies the drive voltage to the piezoelectric pump 22, which is the downstream side pump, at the start timing of one cycle of the drive control cycle. At this time, the fluid control device 10A increases the drive voltage for the piezoelectric pump 22 in a stepwise fashion and sets the drive voltage at the normal operation drive voltage. Subsequently, the fluid control device 10A maintains the normal operation drive voltage for a predetermined time period.

In this state, the fluid control device 10A applies the normal operation drive voltage to the piezoelectric pump 21, which is the upstream side pump, at the drive start timing t20 of the piezoelectric pump 21. At this time, the normal operation drive voltage of the piezoelectric pump 21 (upstream side pump) is lower than the normal operation drive voltage of the piezoelectric pump 22 (downstream side pump). Further, the drive voltage of the piezoelectric pump 22 is decreased temporarily. However, the decreased drive voltage for the piezoelectric pump 22 can be higher than the drive voltage for the piezoelectric pump 21.

Figure 11:
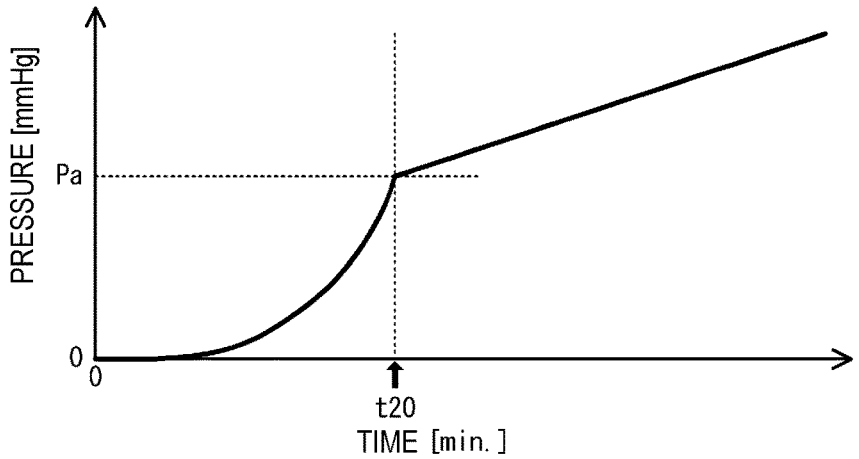
FIG. 11 is a diagram illustrating a change pattern of pressure in the case where the fluid control device 10A of the present application is used.

Note that the drive start timing t20 is set at, for example, the timing at which the pressure of the container 40A reaches a predetermined pressure. FIG. 11 is a diagram illustrating a change pattern of pressure in the case where the fluid control device 10A of the present application is used. As illustrated in FIG. 11, the timing at which the pressure becomes equal to a threshold value Pa is defined as the drive start timing t20 of the piezoelectric pump 21 described above.

Subsequently, the fluid control device 10A gradually increases both the normal operation drive voltage for the piezoelectric pump 21 and the normal operation drive voltage for the piezoelectric pump 22. Further, although it is not illustrated in the drawing, upon reaching a predetermined pressure, the fluid control device 10A stops applying the drive voltage and performs the opening control of the valve 30.

As described above, as is the case with the fluid control device 10, the fluid control device 10A that moves a fluid to the container 40A can suppress unnecessary power consumption and suppress an increase in temperature and a decrease in reliability by implementing the control described above.

Note that in the control described above, the mode is described in which the drive start timing of the piezoelectric pump 21 is delayed from the drive start timing of the piezoelectric pump 22. However, as with the first embodiment, even in the case where the drive start timing of the piezoelectric pump 21 is set equal to the drive start timing of the piezoelectric pump 22, similar functions and effects can be achieved by performing the following control.

Figure 12:
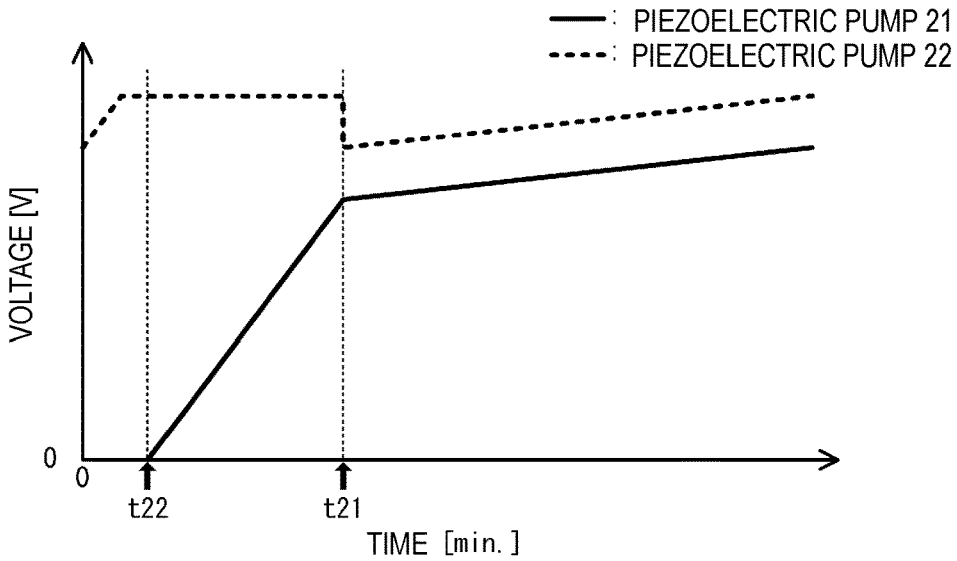
FIG. 12 is a diagram illustrating waveforms of drive voltages for the piezoelectric pump 21 and the piezoelectric pump 22 in a different mode.

FIG. 12 is a diagram illustrating waveforms of drive voltages for the piezoelectric pump 21 and the piezoelectric pump 22 in another mode. As illustrated in FIG. 12, the fluid control device 10A sets the application start timing of drive voltage to the piezoelectric pump 22 and the application start timing of drive voltage to the piezoelectric pump 21 equal to each other. The fluid control device 10A sets the change rate of the drive voltage for the piezoelectric pump 21 during a period of transition lower than the change rate of the drive voltage for the piezoelectric pump 22. That is to say, the application start timing of the normal operation drive voltage for the piezoelectric pump 21 is delayed from the application start timing of the normal operation drive voltage for the piezoelectric pump 22.

Because of this, the fluid control device 10A can suppress the power consumption. Further, with this control, the drive voltage can be applied to the piezoelectric pump 21 from the start timing of one cycle of the drive control cycle, and discharge of fluid to the container 40A and an increase of pressure in the container 40A can be achieved more efficiently.

Figure 13:
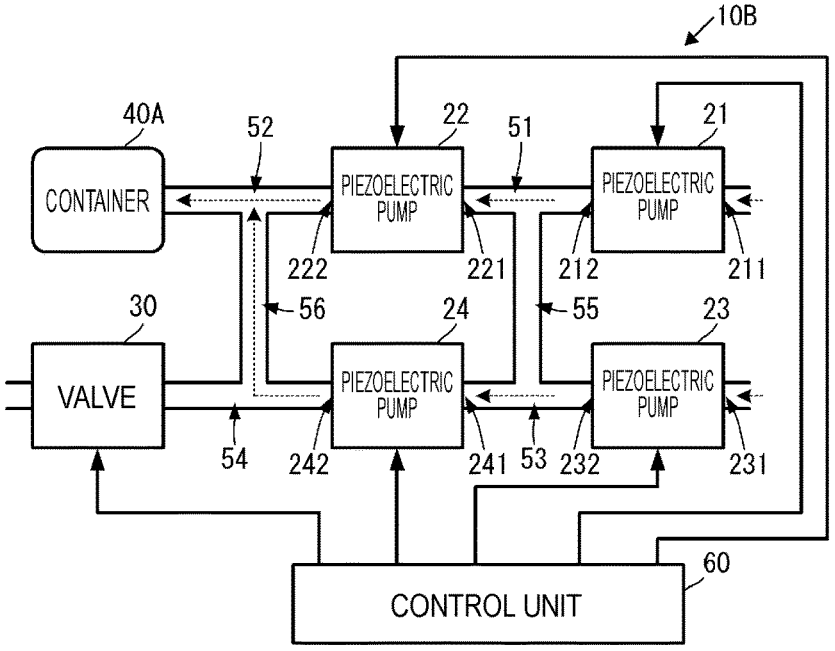
FIG. 13 is a block diagram illustrating the configuration of a fluid control device 10B according to a third embodiment of the present disclosure.

Next, a fluid control device according to a third embodiment of the present disclosure is described with reference to the drawings. FIG. 13 is a block diagram illustrating the configuration of a fluid control device 10B according to a third embodiment of the present disclosure.

As illustrated in FIG. 13, a fluid control device 10B according to the third embodiment is different from the fluid control device 10A according to the second embodiment in that the fluid control device 10B further includes a piezoelectric pump 23, a piezoelectric pump 24, a communicating path 53, a communicating path 54, a communicating path 55, and a communicating path 56. The other configuration of the fluid control device 10B is similar to that of the fluid control device 10A, and the description regarding the similar part is omitted.

The basic configuration of the piezoelectric pump 23 and the piezoelectric pump 24 is the same as the basic configuration of the piezoelectric pump 21 and the piezoelectric pump 22. The piezoelectric pump 23 includes a hole 231 that is a suction inlet and a hole 232 that is a discharge outlet. The piezoelectric pump 24 includes a hole 241 that is a suction inlet and a hole 242 that is a discharge outlet.

The hole 232 of the piezoelectric pump 23 and the hole 241 of the piezoelectric pump 24 are communicating with each other via the communicating path 53. The hole 242 of the piezoelectric pump 24 and the valve 30 are communicating with each other via the communicating path 54. The communicating path 51 and the communicating path 53 are communicating with each other via the communicating path 55, and the communicating path 52 and the communicating path 54 are communicating with each other via the communicating path 56.

In this configuration, the piezoelectric pump 21 and the piezoelectric pump 23 are upstream side pumps, and the piezoelectric pump 22 and the piezoelectric pump 24 are downstream side pumps. That is to say, the fluid control device 10B has the configuration in which two pairs of piezoelectric pumps are connected in series, and the piezoelectric pumps of each pair are connected in parallel with respect to fluid flow paths.

Figures 14, 15:
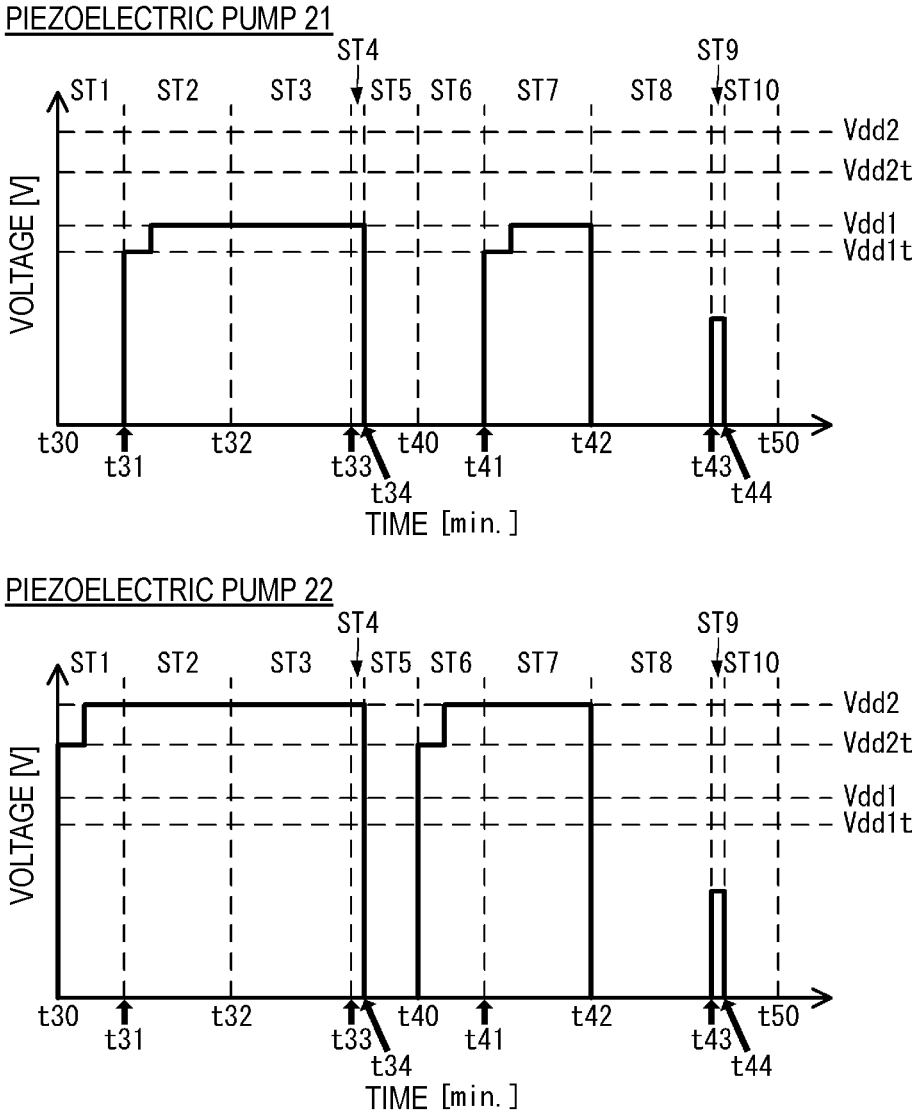
FIG. 14 is a chart illustrating transition states of control in two cycles.
FIG. 15 is a diagram illustrating waveforms of drive voltages for the piezoelectric pump 21 and the piezoelectric pump 22.
Figure 16:
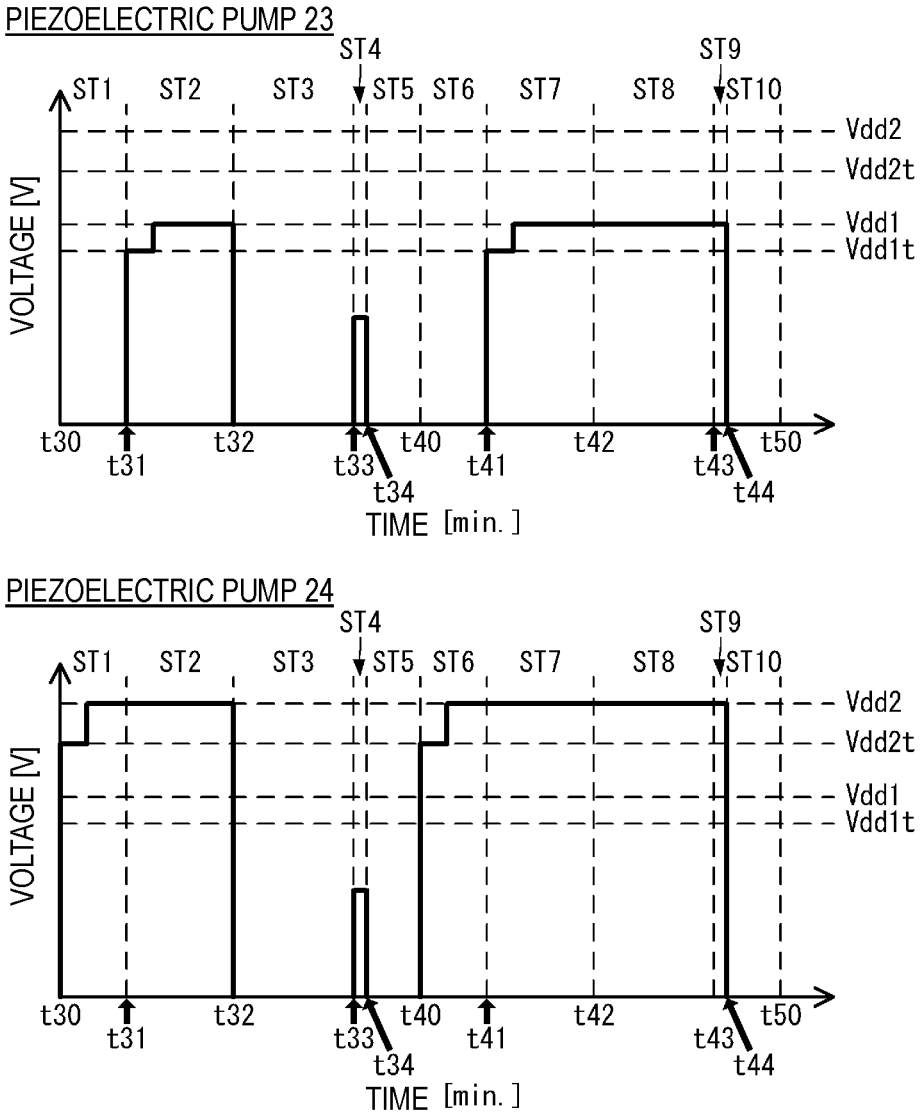
FIG. 16 is a diagram illustrating waveforms of drive voltages for the piezoelectric pump 21 and the piezoelectric pump 22.

For such configuration, the fluid control device 10B performs the following control using the control unit 60. FIG. 14 is a chart illustrating transition states of control in two cycles. FIG. 15 and FIG. 16 are diagrams, each illustrating waveforms of drive voltages for the respective piezoelectric pumps.

(State ST1)

As illustrated in FIG. 14, the fluid control device 10B performs the closing control (CL) of the valve 30. This closing control continues from the state ST1 to the state ST4. Further, at the start timing t30 of the drive control cycle, the fluid control device 10B applies the drive voltage Vdd2 to the piezoelectric pump 22 and the piezoelectric pump 24, and the state ST1 extends to the timing t31. At this time, as illustrated in FIG. 15 and FIG. 16, during a period of transition, the fluid control device 10B increases the drive voltage in a stepwise fashion in such a manner as to include a stage where the drive voltage is set equal to a drive voltage Vdd2*t*. This enables the fluid control device 10B to drive two pumps installed in parallel on the downstream side. This enables the fluid control device 10B to gain a large flow volume.

(State ST2)

Next, as illustrated in FIG. 14, assuming the state ST2 extends from the timing t31 to the timing t32, the fluid control device 10B continues applying the drive voltage Vdd2 to the piezoelectric pump 22 and the piezoelectric pump 24. Further, in the state ST2, the fluid control device 10B applies the drive voltage Vdd1 to the piezoelectric pump 21 and the piezoelectric pump 23. The drive voltage Vdd1 is lower than the drive voltage Vdd2. At this time, as illustrated in FIG. 15 and FIG. 16, during a period of transition, the fluid control device 10B increases the drive voltage in a stepwise fashion in such a manner as to include a stage where the drive voltage is set equal to a drive voltage Vdd1*t*. This enables the fluid control device 10B to drive all the pumps. This enables the fluid control device 10B to gain a large flow volume.

Further, these state ST1 and state ST2 is a period corresponding to the flow volume mode described above, and thus the fluid control device 10B enables to actualize efficient operations for the flow volume mode. Further, in the state ST1, only the downstream side pumps are driven. Therefore, unnecessary power consumption can be suppressed.

(State ST3)

Next, as illustrated in FIG. 14, assuming the state ST3 extends from the timing t32 to the timing t33, the fluid control device 10B continues applying the drive voltage Vdd1 to the piezoelectric pump 21 and the drive voltage Vdd2 to the piezoelectric pump 22. Further, at the timing t33 which is the start of the state ST3, the fluid control device 10B stops applying the drive voltages to the piezoelectric pump 23 and the piezoelectric pump 24. This enables the fluid control device 10B to drive only one pair of pumps connected in series. This state is a period corresponding to the pressure mode described above, and thus the fluid control device 10B enables to actualize efficient operations for the pressure mode. Further, the state ST4 becomes a state where the flow volume hardly increases, and in this state, only two pumps connected in series are driven. Therefore, unnecessary power consumption can be suppressed.

(State ST4)

Next, as illustrated in FIG. 14, assuming the state ST4 extends from the timing t33 to the timing t34, the fluid control device 10B continues applying the drive voltage Vdd1 to the piezoelectric pump 21 and the drive voltage Vdd2 to the piezoelectric pump 22. Further, the fluid control device 10B applies an auxiliary drive voltage to the piezoelectric pump 23 and the piezoelectric pump 24. Further, at the timing t34 which is the end of the state ST4, the fluid control device 10B stops applying the drive voltages to the piezoelectric pump 21, the piezoelectric pump 22, the piezoelectric pump 23, and the piezoelectric pump 24. As described above, by stopping the application of the drive voltages after applying the drive voltages to all the piezoelectric pumps, it becomes possible to ensure that all the piezoelectric pumps are brought back to a normal default state.

(State ST5)

Next, as illustrated in FIG. 14, the fluid control device 10B performs the opening control (OP) of the valve 30. Assuming the state ST5 extends from the timing t34 to the timing t40, the fluid control device 10B continues stopping the application of the drive voltages to the piezoelectric pump 21, the piezoelectric pump 22, the piezoelectric pump 23, and the piezoelectric pump 24.

With these controls, the control for one cycle of the drive control cycle ends.

(State ST6)

As illustrated in FIG. 14, in the state ST6, the fluid control device 10B performs a control similar to that in the state ST1.

(State ST7)

As illustrated in FIG. 14, in the state ST7, the fluid control device 10B performs a control similar to that in the state ST2.

(State ST8)

As illustrated in FIG. 14, in the state ST8, the fluid control device 10B applies the drive voltage to the piezoelectric pump 23 and the piezoelectric pump 24, instead of the piezoelectric pump 21 and piezoelectric pump 22 in the state ST3.

(State ST9)

As illustrated in FIG. 14, in the state ST9, the fluid control device 10B performs a control similar to that in the state ST4.

(State ST10)

As illustrated in FIG. 14, in the state ST10, the fluid control device 10B performs a control similar to that in the state ST5.

With these controls, the control for one cycle of the drive control cycle ends.

As described above, in the control illustrated in FIG. 14, FIG. 15, and FIG. 16, the fluid control device 10B repeats the same control in increments of one cycle of the drive control cycle. Further, both the pressure and the flow volume can be improved by using the configuration of the fluid control device 10B. Further, the fluid control device 10B can suppress unnecessary power consumption.

Further, the life of piezoelectric pump can be prolonged by switching the series-connected piezoelectric pumps to be driven at each cycle, like the state ST3 and the state ST8.

Figure 17:
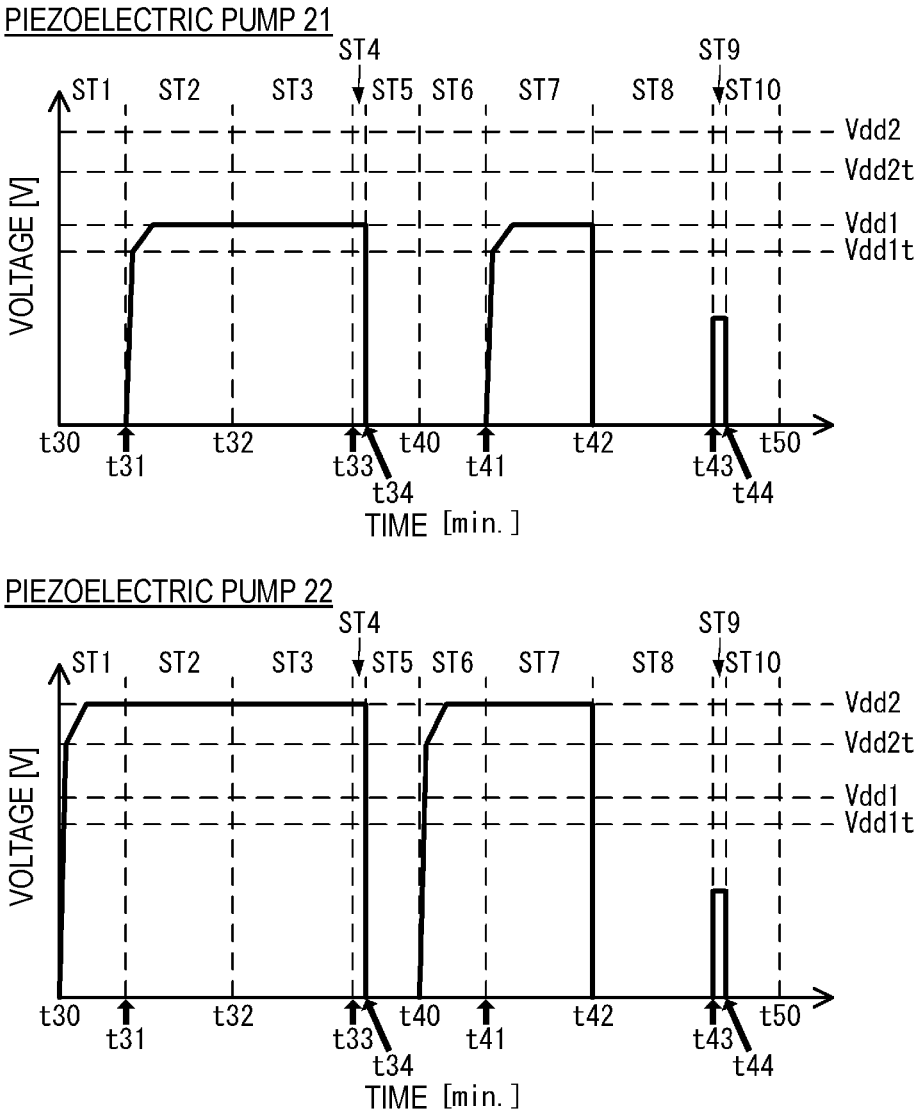
FIG. 17 is a diagram illustrating waveforms of drive voltages for the piezoelectric pump 21 and the piezoelectric pump 22.

Note that in the description described above, the mode is illustrated in which the drive voltage is applied to the piezoelectric pump in a stepwise fashion. However, a mode in which the drive voltage is applied as illustrated in FIG. 17 may also be used. FIG. 17 is a diagram illustrating waveforms of drive voltages for the piezoelectric pump 21 and the piezoelectric pump 22.

As illustrated in FIG. 17, the fluid control device 10B gradually increases the drive voltage during a period of transition for the piezoelectric pump 21 and the piezoelectric pump 22. Note that the drive voltage for the piezoelectric pump 23 is similar to that of the piezoelectric pump 21, and the drive voltage for the piezoelectric pump 24 is similar to that of the piezoelectric pump 22.

Even by using such control of the drive voltage, the pressure and the flow volume can be improved, and unnecessary power consumption can be suppressed. Further, performing such control of the drive voltage enables to drive the piezoelectric pumps more efficiently.

Further, the control for the third embodiment described above enables to provide various derived controls, such as illustrated in FIG. 18A, FIG. 18B, FIG. 18C, and FIG. 18D. FIG. 18A, FIG. 18B, FIG. 18C, and FIG. 18D are charts illustrating transition of states in derived patterns of control.

The controls illustrated in FIG. 18A, FIG. 18B, FIG. 18C, and FIG. 18D are basically similar to the control illustrated in FIG. 14, and only different states are illustrated by hatching. Timings of the closing control and the opening control of the valve in the controls illustrated in FIG. 18A, FIG. 18B, FIG. 18C, and FIG. 18D are the same as those in the control illustrated in FIG. 14.

Figures 18A, 18B, 18C, 18D, 19:
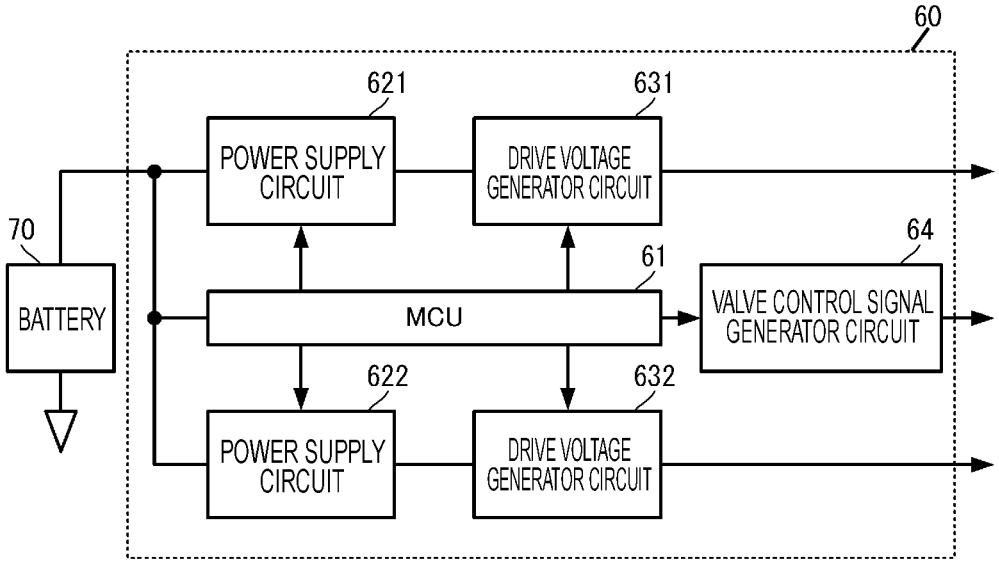
FIG. 18A, FIG. 18B, FIG. 18C, and FIG. 18D are charts illustrating transition of states in derived patterns of control.
FIG. 19 is a functional block diagram of a control unit of the fluid control device.

In the control illustrated in FIG. 18A, compared with the control illustrated in FIG. 14, the same control as that in the state ST3 is performed in the state ST8.

In the control illustrated in FIG. 18B, compared with the control illustrated in FIG. 14, in the state ST3, the drive voltage is applied to the piezoelectric pump 23 and the piezoelectric pump 24, instead of the piezoelectric pump 21 and piezoelectric pump 22.

In the control illustrated in FIG. 18C, compared with the control illustrated in FIG. 14, in the state ST6, the drive voltage is applied to the piezoelectric pump 21 and the piezoelectric pump 23, instead of the piezoelectric pump 22 and piezoelectric pump 24.

In the control illustrated in FIG. 18D, compared with the control illustrated in FIG. 14, in the state ST4, the application of the drive voltage to the piezoelectric pump 21 and the piezoelectric pump 22 continues while no drive voltage is applied to the piezoelectric pump 23 and piezoelectric pump 24. Further, in the state ST9, the application of the drive voltage to the piezoelectric pump 23 and the piezoelectric pump 24 continues while no drive voltage is applied to the piezoelectric pump 21 and piezoelectric pump 22.

The control patterns are not limited to those described above, and those control patterns may be combined as needed.

Note that the control units 60 according to the first and second embodiments described above may be actualized using the following configuration, for example. FIG. 19 is a functional block diagram of the control unit of the fluid control device.

As illustrated in FIG. 19, the control unit 60 includes an MCU 61, a power supply circuit 621, a power supply circuit 622, a drive voltage generation circuit 631, a drive voltage generation circuit 632, and a valve control signal generation circuit 64. The control unit 60 is a device that actualizes "first control unit" and "second control unit" of the present disclosure using a single IC.

The MCU 61 is connected to the power supply circuit 621, the power supply circuit 622, the drive voltage generation circuit 631, the drive voltage generation circuit 632, and the valve control signal generation circuit 64. Power supply voltages are being supplied from a battery 70 to the MCU 61, the power supply circuit 621, and the power supply circuit 622. The MCU 61 performs drive controls for the power supply circuit 621, the power supply circuit 622, the drive voltage generation circuit 631, the drive voltage generation circuit 632, and the valve control signal generation circuit 64. For example, the control of the drive voltage value, the control of output timing of the drive voltage, the control of output timing of the valve control signal, and the like are performed.

The power supply circuit 621 converts the power supply voltage into a voltage to be applied to the piezoelectric pump 21 and outputs to the drive voltage generation circuit 631. The power supply circuit 622 converts the power supply voltage into a voltage to be applied to the piezoelectric pump 22 and outputs to the drive voltage generation circuit 632.

The drive voltage generation circuit 631 converts the voltage from the power supply circuit 621 into a waveform for driving the piezoelectric pump 21 and outputs to the piezoelectric pump 21.

The drive voltage generation circuit 632 converts the voltage from the power supply circuit 622 into a waveform for driving the piezoelectric pump 22 and outputs to the piezoelectric pump 22.

The valve control signal generation circuit 64 generates a valve control signal for the closing control and a valve control signal for the opening control and outputs to the valve 30.

Note that the control unit 60 according to the third embodiment can be actualized by adding two more pairs of the power supply circuit and the drive voltage generation circuit illustrated in FIG. 19.

Further, the control unit 60 may have a configuration in which a first control unit for applying the drive voltage to the piezoelectric pump and a second control unit for outputting the control signal to the valve are provided separately. In this case, in the configuration of FIG. 19, the first control unit includes a device in which a control unit at least performing the drive controls of the piezoelectric pumps using the drive voltage generation circuit 631, the drive voltage generation circuit 632, and the MCU 61 are packaged into a single unit. Further, the second control unit includes a device in which functionalities for performing the valve control in the valve control signal generation circuit 64 and the MCU 61 are packaged into a single unit. Note that the actualization of the first control unit and the second control unit using the singly packaged devices facilitates synchronization of the drive voltage and the valve control signal.

Further, the control unit 60 can be actualized using the following various circuit configurations.

(Separately Excited Oscillation Type)

Figure 20:
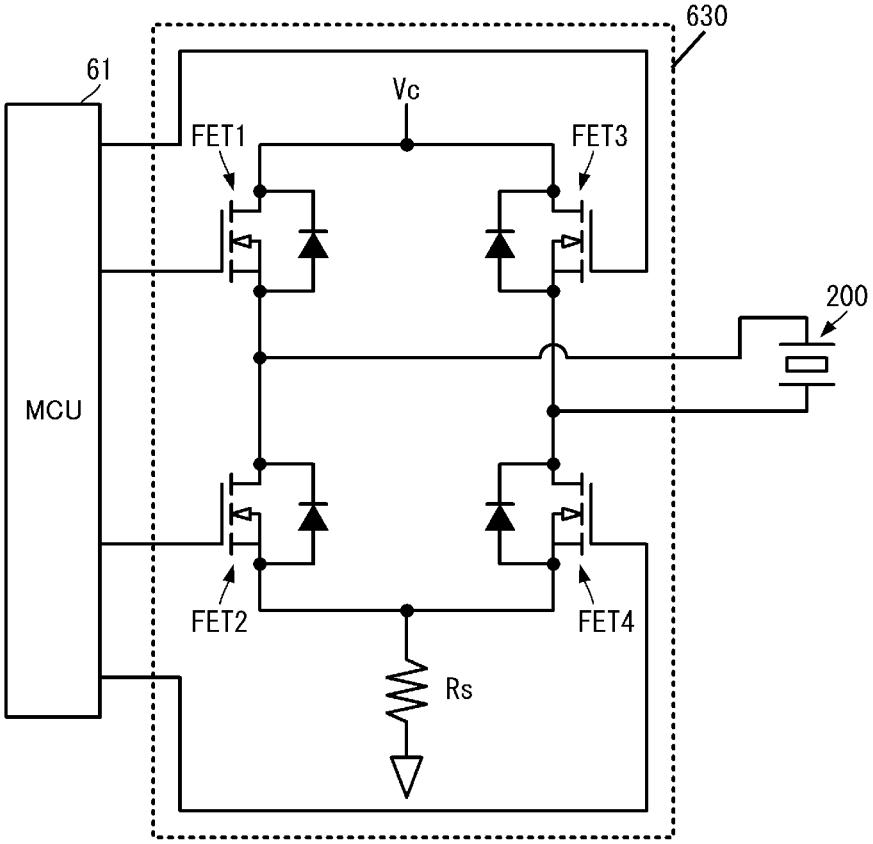
FIG. 20 is a first example of circuit configuration of the control unit.

FIG. 20 is a first example of the circuit configuration of the control unit.

FIG. 20 includes the MCU 61 and a drive voltage generation circuit 630. This circuit is a circuit that drives and controls a single piezoelectric pump (piezoelectric element 200). Therefore, in a mode where a plurality of piezoelectric pumps is controlled and driven, such as the ones described above, the same number of the drive voltage generation circuits 630 as the piezoelectric pumps is included.

The drive voltage generation circuit 630 is a full bridge circuit including FET1, FET2, FET3, and FET4. The gate of FET1, the gate of FET2, the gate of FET3, and the gate of FET4 are connected to the MCU 61.

The drain of FET1 and the drain of FET3 are connected to each other. A voltage Vc obtained from the power supply voltage is supplied to the drain of FET1 and the drain of FET3.

The source of FET1 is connected to the drain of FET2, and the source of FET2 is connected to a reference potential. The source of FET3 is connected to the drain of FET4, and the source of FET4 is connected to the reference potential via a resistive element Rs.

A connection point of the source of FET1 and the drain of FET2 is connected to one terminal of the piezoelectric element 200, and a connection point of the source of FET3 and the drain of FET4 is connected to the other terminal of the piezoelectric element 200.

The MCU 61 performs, as a first control state, a turn-on control (conduction control) of FET1 and FET4 and a turn-off control (open control) of FET2 and FET3. Further, the MCU 61 performs, as a second control state, the turn-off control (open control) of FET1 and FET4 and the turn-on control (conduction control) of FET2 and FET3. The MCU 61 performs the first control state and the second control state in this order. At this time, the MCU 61 performs the control in such a way that the time during which the first control state and the second control state are sequentially performed becomes equal to the period (inverse of resonant frequency) of the piezoelectric pump (piezoelectric element 200). This allows to apply the drive voltage to the piezoelectric element 200, thereby driving the piezoelectric pump.

(Self-Excited Oscillation Type)

Figure 21:
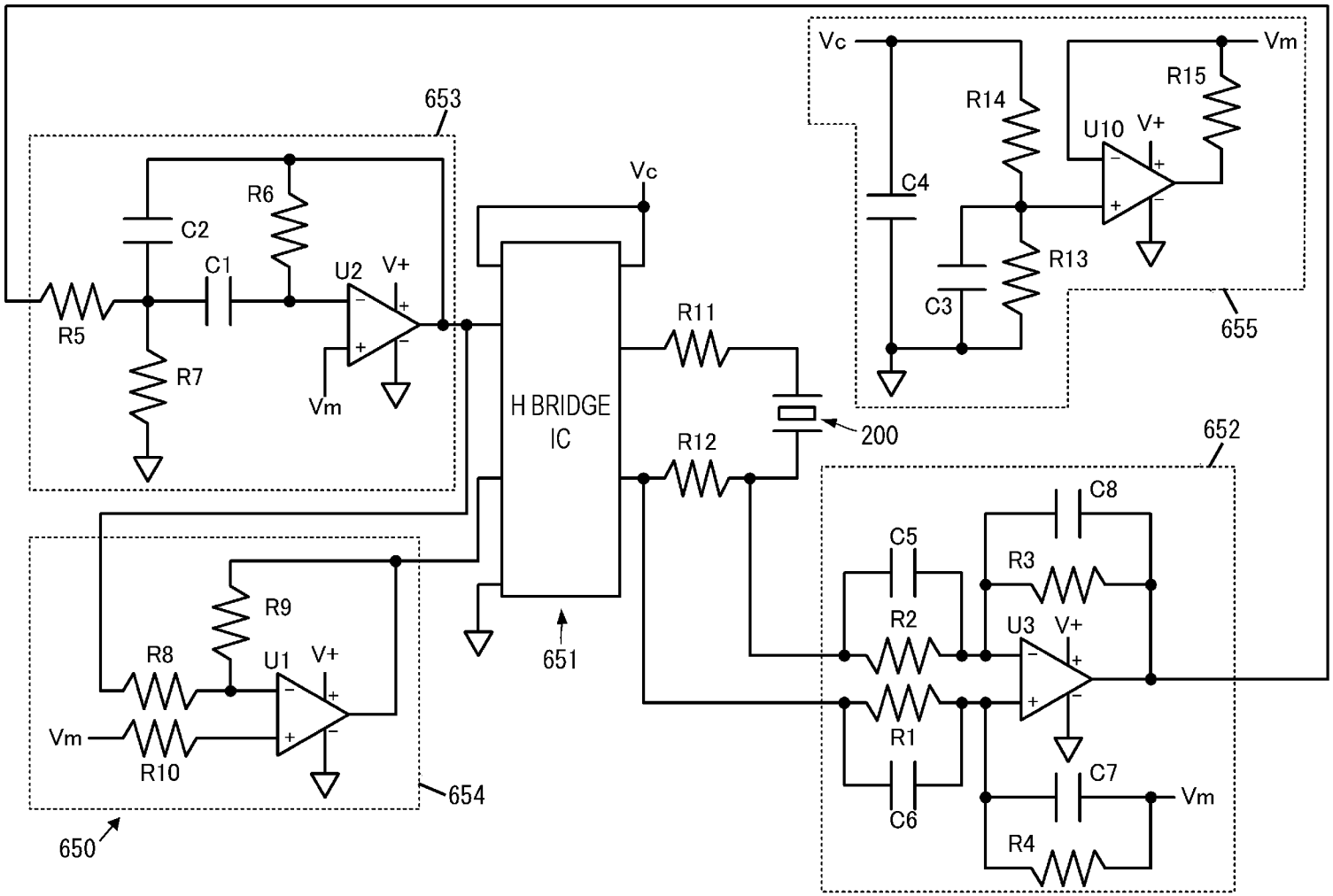
FIG. 21 is a circuit diagram illustrating a first example of a self-excited oscillation type drive voltage generation circuit.

FIG. 21 is a circuit diagram illustrating a first example of a self-excited oscillation type drive voltage generation circuit 650.

As illustrated in FIG. 21, the drive voltage generation circuit 650 includes a H-bridge IC (Integrated Circuit) 651, a differential circuit 652, an amplifier circuit 653, a phase reversing circuit 654, and an intermediate voltage generation circuit 655.

In outline, the drive voltage generation circuit 650 operates in the following manner.

The H-bridge IC 651 receives supply of the voltage Vc, receives an output of the amplifier circuit 653 and an output of the phase reversing circuit 654, and outputs drive voltages having the same absolute value and opposite phases to each other from a first output terminal and a second output terminal to the piezoelectric element 200. The piezoelectric element 200 is excited by receiving these drive voltages, thereby driving the piezoelectric pump.

The differential circuit 652 differentially amplifies voltages at both ends of a resistive element R12 caused by a current flowing through the piezoelectric element 200 and outputs to the amplifier circuit 653. The amplifier circuit 653 amplifies an output voltage of the differential circuit 652 and outputs to the H-bridge IC 651 and the phase reversing circuit 654. The phase reversing circuit 654 reverses the phase of an output voltage of the amplifier circuit 653 and outputs to the H-bridge IC 651.

By performing such feedback control, the piezoelectric element 200 is driven at an optimum frequency based on the impedances of respective circuit elements that constitute the drive voltage generation circuit 650 and the piezoelectric element 200.

As illustrated in FIG. 21, a specific circuit configuration of the drive voltage generation circuit 650 is, for example, the following circuit configuration.

The intermediate voltage generation circuit 655 includes an operational amplifier U10, a resistive element R13, a resistive element R14, a resistive element R15, a capacitor C3, and a capacitor C4.

The resistive element R14 and the resistive element R13 are connected in series in this order in between a supply point of the voltage Vc and the reference potential. The capacitor C3 is connected in parallel to the resistive element R13. The capacitor C4 is connected in parallel to a series circuit of the resistive element R14 and the resistive element R13. A non-inverting input terminal of the operational amplifier U10 is connected to a connection point of the resistive element R13 and the resistive element R14. An output terminal of the operational amplifier U10 is connected to an inverting input terminal of the operational amplifier U10 via a resistive element R15. The intermediate voltage generation circuit 655 outputs, as an intermediate voltage Vm, a voltage of a terminal of the resistive element R15 opposite to a terminal connected to the output terminal of the operational amplifier U10.

A first output terminal of the H-bridge IC 651 is connected to one of terminals of the piezoelectric element 200 via a resistive element R11. A second output terminal of the H-bridge IC 651 is connected to the other terminal of the piezoelectric element 200 via a resistive element R12.

The differential circuit 652 includes an operational amplifier U3, a resistive element R1, a resistive element R2, a resistive element R3, a resistive element R4, a capacitor C5, a capacitor C6, a capacitor C7, and a capacitor C8.

A drive voltage V+ is supplied to the operational amplifier U3. An inverting input terminal of the operational amplifier U3 is connected to the piezoelectric element 200 side of the resistive element R12 for current detection via a parallel circuit of the resistive element R2 and the capacitor C5. A non-inverting input terminal of the operational amplifier U3 is connected to the H-bridge IC 651 side of the resistive element R12 via a parallel circuit of the resistive element R1 and the capacitor C6. The intermediate voltage Vm is supplied to the non-inverting input terminal of the operational amplifier U3 via a parallel circuit of the resistive element R4 and the capacitor C7. An output terminal of the operational amplifier U3 is connected to an inverting input terminal of the operational amplifier U3 via a parallel circuit of the resistive element R3 and the capacitor C8.

The amplifier circuit 653 includes an operational amplifier U2, a resistive element R5, a resistive element R6, a resistive element R7, a capacitor C1, and a capacitor C2.

The drive voltage V+ is supplied to the operational amplifier U2. An inverting input terminal of the operational amplifier U2 is connected to the output terminal of the operational amplifier U3 of the differential circuit 652 via the capacitor C1 and the resistive element R5. A connection point of the capacitor C1 and the resistive element R5 is connected to the reference potential via the resistive element R7. One terminal of the capacitor C2 is connected to a connection point of the capacitor C1 and the resistive element R5, and the other terminal of the capacitor C2 is connected to one terminal of the resistive element R6. The other terminal of the resistive element R6 is connected to an inverting input terminal of the operational amplifier U2. The intermediate voltage Vm is supplied to a non-inverting input terminal of the operational amplifier U2. An output terminal of the operational amplifier U2 is connected to the one terminal of the resistive element R6. Further, the output terminal of the operational amplifier U2 is connected to the H-bridge IC 651.

The phase reversing circuit 654 includes an operational amplifier U1, a resistive element R8, a resistive element R9, and a resistive element R10.

The drive voltage V+ is supplied to the operational amplifier U1. An inverting input terminal of the operational amplifier U1 is connected to the output terminal of the operational amplifier U2 of the amplifier circuit 653 via the resistive element R8. The intermediate voltage Vm is supplied to a non-inverting input terminal of the operational amplifier U1 via the resistive element R10. An output terminal of the operational amplifier U1 is connected to the inverting input terminal of the operational amplifier U1 via the resistive element R9. Further, the output terminal of the operational amplifier U1 is connected to the H-bridge IC 651.

Figure 22:
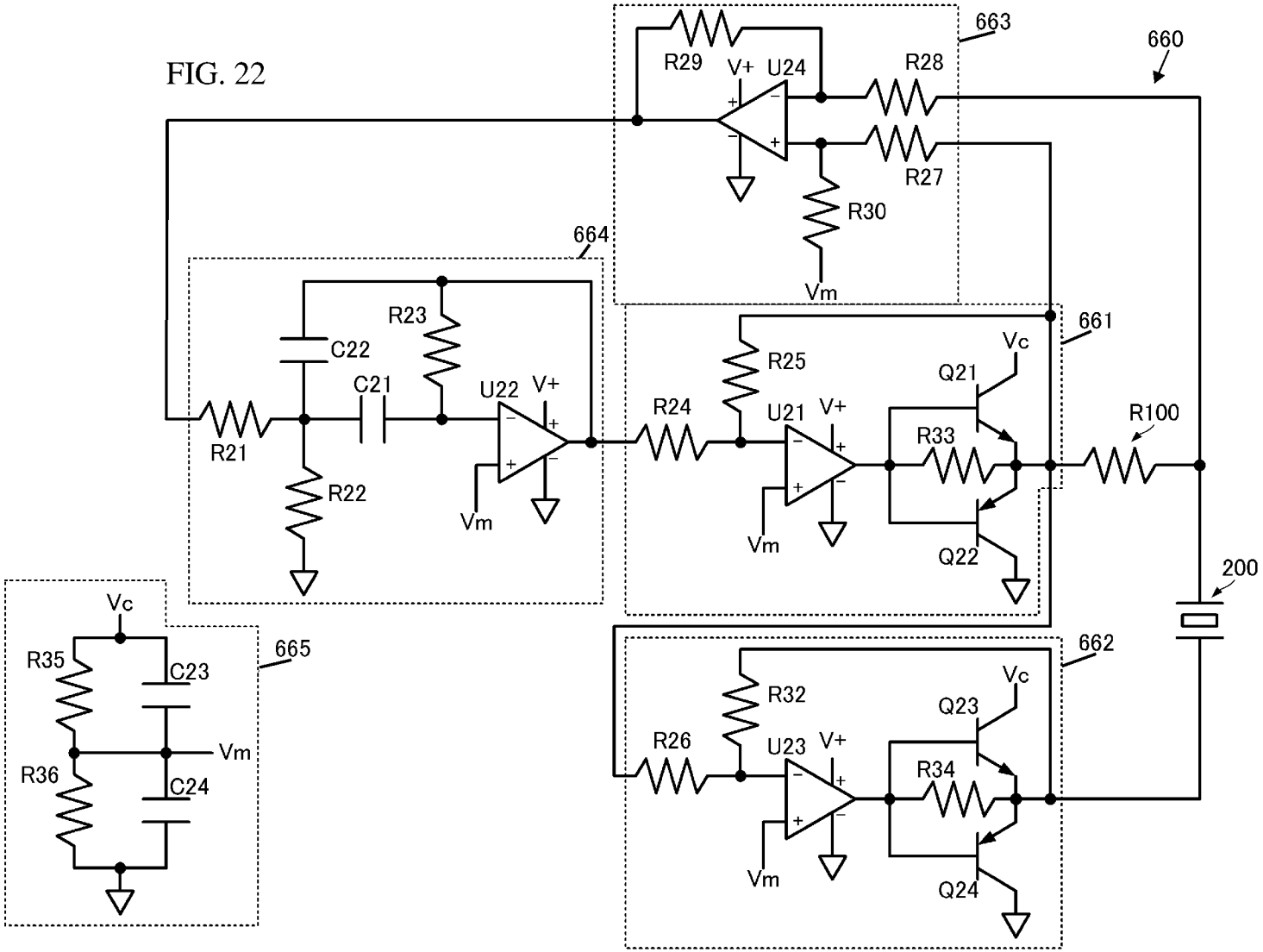
FIG. 22 is a circuit diagram illustrating a second example of a self-excited oscillation type drive voltage generation circuit.

FIG. 22 is a circuit diagram illustrating a second example of a self-excited oscillation type drive voltage generation circuit 660.

As illustrated in FIG. 22, the drive voltage generation circuit 660 includes an amplifier circuit 661, a phase reversing circuit 662, a differential circuit 663, a filter circuit 664, and an intermediate voltage generation circuit 665.

In outline, the drive voltage generation circuit 660 operates in the following manner.

The amplifier circuit 661 supplies a first drive voltage to the one terminal of the piezoelectric element 200 via a resistive element R100. The phase reversing circuit 662 supplies a second drive voltage to the other terminal of the piezoelectric element 200. The first drive voltage and the second drive voltage are opposite phase voltages having the same absolute value. The piezoelectric element 200 is excited by receiving these drive voltages, thereby driving the piezoelectric pump.

The differential circuit 663 differentially amplifies voltages at both ends of the resistive element R100 caused by a current flowing through the piezoelectric element 200 and outputs to the filter circuit 664. The filter circuit 664 filters an output voltage of the differential circuit 663 and outputs to the amplifier circuit 661. The amplifier circuit 661 receives an output voltage of the filter circuit 664 and outputs the first drive voltage. The phase reversing circuit 662 receives the first drive voltage, reverses the phase thereof, and outputs the second drive voltage.

By performing such feedback control, the piezoelectric element 200 is driven at an optimum frequency based on impedances of respective circuit elements that constitute the drive voltage generation circuit 660 and the piezoelectric element 200.

As illustrated in FIG. 22, a specific circuit configuration of the drive voltage generation circuit 660 is, for example, the following circuit configuration.

The intermediate voltage generation circuit 665 includes a resistive element R35, a resistive element R36, a capacitor C23, and a capacitor C24.

The resistive element R35 and the resistive element R36 are connected in series in this order in between the supply point of the voltage Vc and the reference potential. The capacitor C23 is connected in parallel to the resistive element R35. The capacitor C24 is connected in parallel to the resistive element R36. The intermediate voltage generation circuit 665 outputs, as the intermediate voltage Vm, a divided voltage obtained by the resistive element R35 and the resistive element R36.

The amplifier circuit 661 includes an operational amplifier U21, a transistor Q21, a transistor Q22, a resistive element R24, and a resistive element R25.

One end portion of the resistive element R24 is an input port of the amplifier circuit 661 and is connected to an output terminal of an operational amplifier U24 of the filter circuit 664.

The other end portion of the resistive element R24 is connected to an inverting input terminal of the operational amplifier U21. The intermediate voltage Vm is supplied to a non-inverting input terminal of the operational amplifier U21. The drive voltage V+ is supplied to the operational amplifier U21. An output terminal of the operational amplifier U21 is connected to a base terminal of the transistor Q21 and a base terminal of the transistor Q22.

The transistor Q21 is a n-type transistor. The transistor Q22 is a p-type transistor. The voltage Vc is supplied to a collector terminal of the transistor Q21. An emitter terminal of the transistor Q21 and an emitter terminal of the transistor Q22 are connected. A collector terminal of the transistor Q22 is connected to ground. A resistive element R33 is connected between a connecting part of the base terminals of the transistor Q21 and the transistor Q22 and a connecting part of the emitter terminal of the transistor Q21 and the emitter terminal of the transistor Q22.

The connecting part of the emitter terminal of the transistor Q21 and the emitter terminal of the transistor Q22 is an output port of the amplifier circuit 661 and is connected to one end portion of the resistive element R100. The other end portion of the resistive element R100 is connected to the one terminal of the piezoelectric element 200.

The phase reversing circuit 662 includes an operational amplifier U23, a transistor Q23, a transistor Q24, a resistive element R26, a resistive element R32, and a resistive element R34.

One end portion of the resistive element R26 is an input port of the phase reversing circuit 662 and is connected to a connecting part of the emitter terminal of the transistor Q21 and the emitter terminal of the transistor Q22. The other end portion of the resistive element R26 is connected to an inverting input terminal of the operational amplifier U23. The intermediate voltage Vm is supplied to a non-inverting input terminal of the operational amplifier U23. The drive voltage V+ is supplied to the operational amplifier U23. An output terminal of the operational amplifier U23 is connected to a base terminal of the transistor Q23 and a base terminal of the transistor Q24.

The transistor Q23 is a n-type transistor. The transistor Q24 is a p-type transistor. The voltage Vc is supplied to a collector terminal of the transistor Q23. An emitter terminal of the transistor Q23 and an emitter terminal of the transistor Q24 are connected. A collector terminal of the transistor Q24 is connected to the ground. A resistive element R34 is connected between a connecting part of the base terminals of the transistor Q23 and the transistor Q24 and a connecting part of the emitter terminal of the transistor Q23 and the emitter terminal of the transistor Q24.

The resistive element R32 is connected between a connecting part of the emitter terminal of the transistor Q23 and the emitter terminal of the transistor Q24 and the inverting input terminal of the operational amplifier U23.

The connecting part of the emitter terminal of the transistor Q23 and the emitter terminal of the transistor Q24 is an output port of the phase reversing circuit 662 and is connected to the other terminal of the piezoelectric element 200.

The differential circuit 663 includes an operational amplifier U24, a resistive element R27, a resistive element R28, a resistive element R29, and a resistive element R30.

The drive voltage V+ is supplied to the operational amplifier U24. A non-inverting input terminal of the operational amplifier U24 is connected to an output port of the amplifier circuit 661 (one end portion of the resistive element R100) via the resistive element R27. Further, the intermediate voltage Vm is supplied to the non-inverting input terminal of the operational amplifier U24 via the resistive element R30. An inverting input terminal of the operational amplifier U24 is connected to the other end portion of the resistive element R100 via the resistive element R28. The resistive element R29 is connected between an output terminal and the inverting input terminal of the operational amplifier U24. The output port of the operational amplifier U24 is an output port of the differential circuit 663.

The filter circuit 664 includes an operational amplifier U22, a resistive element R21, a resistive element R22, a resistive element R23, a capacitor C21, and a capacitor C22.

One end portion of the resistive element R21 is an input port of the filter circuit 664. The other end portion of the resistive element R21 is connected to one end portion of the capacitor C21. A connecting part of the resistive element R21 and the capacitor C21 is connected to the ground via the resistive element R22. The other end portion of the capacitor C21 is connected to an inverting input terminal of the operational amplifier U22. The drive voltage V+ is supplied to the operational amplifier U22. The intermediate voltage Vm is supplied to a non-inverting input terminal of the operational amplifier U22.

The resistive element R23 is connected between an output port of the operational amplifier U22 and the inverting input terminal of the operational amplifier U22. The capacitor C22 is connected between a connecting part of the resistive element R21 and the capacitor C21 and the resistive element R23 on the output port side of the operational amplifier U22.

In the case where these self-excited oscillation type drive voltage generation circuits are used, the valve control signal generation circuit 64 may, for example, monitor the drive voltage and output a valve control signal in such a manner as to synchronize with the drive voltage.

Further, in the description described above, the following is set as conditions: The time it takes for the upstream side pump to reach the normal operation drive voltage is longer than the time it takes for the downstream side pump to reach the normal operation drive voltage, and the drive voltage of the upstream side pump is lower than the drive voltages of a plurality of downstream side pumps. Further, in the description described above, both the conditions are satisfied. However, in the fluid control devices, only at least one of these conditions needs to be set.

Further, in the description described above, the number of piezoelectric pumps to be connected in series is two and may alternatively be three or more. In this case, the time it takes for at least the most upstream side pump to reach the normal operation drive voltage may only need to be longer than the time it takes for any of a plurality of downstream side pumps to reach their normal operation drive voltages.

Further, the drive voltage of at least the most upstream side pump may only need to be lower than the drive voltage of any of the plurality of downstream side pumps.

Further, the number of the piezoelectric pumps to be connected in parallel is not limited to two and may alternatively be three or more.

REFERENCE SIGNS LIST

10, 10A, 10B: Fluid control device
21, 22, 23, 24: Piezoelectric pump
30: Valve
40, 40A: Container
51, 52, 53, 54, 55, 56: Communicating path
60: Control unit
61: MCU
64: Valve control signal generation circuit
70: Battery
211, 212, 221, 222, 231, 232, 241, 242: Hole
621, 622: Power supply circuit
631, 632, 650, 660: Drive voltage generation circuit
651: H-bridge IC
652, 663: Differential circuit
653, 661: Amplifier circuit
654, 662: Phase reversing circuit
655, 665: Intermediate voltage generation circuit
664: Filter circuit

The invention claimed is:

1. A fluid control device comprising:

a first pump including a first hole and a second hole, the first pump being operable to move fluid between the first hole and the second hole;

a second pump including a third hole and a fourth hole, the second pump being operable to move fluid between the third hole and the fourth hole;

a container;

a first communicating path communicating with the second hole and the third hole;

a second communicating path communicating with the fourth hole and the container;

a valve installed in the second communicating path, the valve being operable between an open state that opens the second communicating path to outside and a closed state that closes the second communicating path from the outside;

a first control unit configured to control driving of the first pump and the second pump to perform a drive control cycle that repeatedly starts and stops operation of the first pump and the second pump; and a second control unit configured to control switching of the valve between the open state and the closed state, wherein during one cycle of the drive control cycle:

one of the first pump and the second pump is an upstream side pump with respect to a flow of fluid, and the other of the first pump and the second pump is a downstream side pump with respect to the flow of fluid, the second control unit is configured to close the valve at a beginning of the one cycle and open the valve when the first pump and the second pump stop, and the first control unit is configured to apply a first drive voltage to the upstream side pump and a second drive voltage to the downstream side pump, wherein a length of time from the beginning of the one cycle of the drive control cycle to a time at which the first drive voltage reaches a first normal operation drive voltage is longer than a length of time from the beginning of the one cycle to a time at which the second drive voltage reaches a second normal operation drive voltage.

2. The fluid control device according to claim 1, wherein the first normal operation drive voltage of the upstream side pump is lower than the second normal operation drive voltage of the downstream side pump.

3. The fluid control device according to claim 1, wherein the first drive voltage is equal to or less than the second drive voltage.

4. The fluid control device according to claim 1, wherein during the one cycle, the first control unit is configured to apply the first drive voltage to the upstream side pump after stopping the upstream side pump for a predetermined time period from the beginning of the one cycle.

5. The fluid control device according to claim 1, wherein during the one cycle, the first control unit is configured to apply the first drive voltage to the upstream side pump and the second drive voltage to the downstream side pump such that:

the first drive voltage and second drive voltage are applied simultaneously at the beginning of the one cycle, and a change rate of the first drive voltage for the upstream side pump during a period of transition is lower than a change rate of the second drive voltage for the downstream side pump during a period of transition.

6. The fluid control device according to claim 1, wherein the first control unit and the second control unit are formed into a single control device.

7. The fluid control device according to claim 1, wherein during the one cycle, the first control unit is configured to stop the downstream side pump after stopping the upstream side pump.

8. The fluid control device according to claim 2, wherein during the one cycle, the first control unit is configured to apply the first drive voltage to the upstream side pump after stopping the upstream side pump for a predetermined time period from the beginning of the one cycle.

9. The fluid control device according to claim 3, wherein during the one cycle, the first control unit is configured to apply the first drive voltage to the upstream side pump after stopping the upstream side pump for a predetermined time period from the beginning of the one cycle.

10. The fluid control device according to claim 2, wherein during the one cycle, the first control unit is configured to apply the first drive voltage to the upstream side pump and the second drive voltage to the downstream side pump such that:

the first drive voltage and the second drive voltage are applied simultaneously at the beginning of the one cycle, and a change rate of the first drive voltage for the upstream side pump during a period of transition is lower than a change rate of the second drive voltage for the downstream side pump during a period of transition.

11. The fluid control device according to claim 3, wherein during the one cycle, the first control unit is configured to apply the first drive voltage to the upstream side pump and the second drive voltage to the downstream side pump such that:

the first drive voltage and the second drive voltage are applied simultaneously at the beginning of the one cycle, and a change rate of the first drive voltage for the upstream side pump during a period of transition is lower than a change rate of the second drive voltage for the downstream side pump during a period of transition.

12. The fluid control device according to claim 4, wherein during the one cycle, the first control unit is configured to apply the first drive voltage to the upstream side pump and the second drive voltage to the downstream side pump such that:

the first drive voltage and the second drive voltage are applied simultaneously at the beginning of the one cycle, and a change rate of the first drive voltage for the upstream side pump during a period of transition is lower than a change rate of the second drive voltage for the downstream side pump during a period of transition.

13. The fluid control device according to claim 2, wherein the first control unit and the second control unit are formed into a single control device.

14. The fluid control device according to claim 3, wherein the first control unit and the second control unit are formed into a single control device.

15. The fluid control device according to claim 4, wherein the first control unit and the second control unit are formed into a single control device.

16. The fluid control device according to claim 5, wherein the first control unit and the second control unit are formed into a single control device.

17. The fluid control device according to claim 2, wherein during the one cycle, the first control unit is configured to stop the downstream side pump after stopping the upstream side pump.

18. The fluid control device according to claim 3, wherein during the one cycle, the first control unit is configured to stop the downstream side pump after stopping the upstream side pump.

19. The fluid control device according to claim 4, wherein during the one cycle, the first control unit is configured to stop the downstream side pump after stopping the upstream side pump.

20. A method of operating the fluid control device according to claim 1, wherein the first control unit controls driving of the first pump and the second pump to perform the one cycle of the drive control cycle, wherein during the one cycle of the drive control cycle:

the second control unit closes the valve at the beginning of the one cycle and opens the valve when the first pump and the second pump stop, and the first control unit applies the first drive voltage to the upstream side pump and the second drive voltage to the downstream side pump, wherein the length of time from the beginning of the one cycle of the drive control cycle to the time at which the first drive voltage reaches the first normal operation drive voltage is longer than the length of time from the beginning of the one cycle to the time at which the second drive voltage reaches the second normal operation drive voltage.

* * * * *